US010672321B2

(12) United States Patent
Choi et al.

(10) Patent No.: US 10,672,321 B2
(45) Date of Patent: Jun. 2, 2020

(54) DISPLAY APPARATUS AND METHOD OF OPERATING THE SAME BASED ON N GATE CLOCK CONTROL SIGNALS

(71) Applicant: Samsung Display Co., Ltd., Yongin-Si, Gyeonggi-Do (KR)

(72) Inventors: Min-Soo Choi, Hwaseong-si (KR); Junpyo Lee, Asan-si (KR); Yu-Chol Kim, Pyeongtaek-si (KR); Jeong-Hyun Kim, Seongnam-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 15/806,555

(22) Filed: Nov. 8, 2017

(65) Prior Publication Data

US 2018/0137804 A1 May 17, 2018

(30) Foreign Application Priority Data

Nov. 11, 2016 (KR) ..... 10-2016-0150427

(51) Int. Cl.

| | |
|---|---|
| ***G09G 5/10*** | (2006.01) |
| ***G09G 3/20*** | (2006.01) |
| ***G09G 3/36*** | (2006.01) |

(52) U.S. Cl.

CPC ..... *G09G 3/2092* (2013.01); *G09G 3/2003* (2013.01); *G09G 3/3677* (2013.01); *G09G 2300/0408* (2013.01); *G09G 2300/0452* (2013.01); *G09G 2300/0871* (2013.01); *G09G 2310/0213* (2013.01); *G09G 2310/0218* (2013.01); *G09G 2310/0235* (2013.01); *G09G 2310/0243* (2013.01); *G09G 2310/0267* (2013.01); *G09G 2310/0278* (2013.01); *G09G 2310/0289* (2013.01); *G09G 2310/08* (2013.01)

(58) Field of Classification Search

CPC ... G09G 3/3674; G09G 3/2092; G09G 3/2003
USPC ..... 345/691
See application file for complete search history.

(56) References Cited

U.S. PATENT DOCUMENTS

| | | | | |
|---|---|---|---|---|
| 2008/0012842 A1 | 1/2008 | Mori | | |
| 2010/0007635 A1 * | 1/2010 | Kwon | G09G 3/3677 | 345/204 |

(Continued)

FOREIGN PATENT DOCUMENTS

| | | |
|---|---|---|
| KR | 1020080049537 A | 6/2008 |
| KR | 1020140109019 A | 9/2014 |

*Primary Examiner* — Adam J Snyder
(74) *Attorney, Agent, or Firm* — Cantor Colburn LLP

(57) ABSTRACT

A display apparatus includes a gate driving control circuit, a gate driver and a display panel. The gate driving control circuit generates N gate clock signals and N inversion gate clock signals based on N gate clock control signals, phases of which partially overlap with each other. Each inversion gate clock signals has an opposite phase to a respective gate clock signal. The gate driver generates gate signals based on the N gate clock signals or the N inversion gate clock signals and applies the gate signals to gate lines. The display panel includes pixels, each connected to a respective gate line and a respective data line. Each of the pixels has a longer side in parallel with gate lines and a shorter side in parallel with the data lines. A number of the gate clock control signals is an integer multiple of a number of colors of the pixels.

16 Claims, 17 Drawing Sheets

(56) References Cited

U.S. PATENT DOCUMENTS

| | | | | |
|---|---|---|---|---|
| 2010/0156869 | A1* | 6/2010 | Lee | G09G 3/3677 345/208 |
| 2010/0220079 | A1* | 9/2010 | Bang | G09G 3/3648 345/204 |
| 2011/0128259 | A1* | 6/2011 | Suzuki | G09G 3/003 345/204 |
| 2011/0156992 | A1* | 6/2011 | Moon | G09G 3/3607 345/84 |
| 2011/0157132 | A1* | 6/2011 | Byun | G09G 3/3677 345/211 |
| 2012/0062526 | A1* | 3/2012 | Wen | G09G 3/3648 345/204 |
| 2012/0098813 | A1* | 4/2012 | Park | G09G 3/3611 345/211 |
| 2014/0253418 | A1* | 9/2014 | Pyun | G09G 3/3696 345/52 |

* cited by examiner

DISPLAY APPARATUS AND METHOD OF OPERATING THE SAME BASED ON N GATE CLOCK CONTROL SIGNALS

This application claims priority to Korean Patent Application No. 10-2016-0150427, filed on Nov. 11, 2016, and all the benefits accruing therefrom under 35 U.S.C. § 119, the content of which in its entirety is herein incorporated by reference.

BACKGROUND

1. Field

Exemplary embodiments relate to a display apparatus and a method of operating the display apparatus.

2. Description of the Related Art

A liquid crystal display apparatus is one of the most widely used types of flat panel display ("FPD"). The FPD may include, but is not limited to, a liquid crystal display ("LCD"), a plasma display panel ("PDP") and an organic light emitting display ("OLED"), for example.

A display apparatus typically includes a display panel, in which a plurality of pixels are connected to respective gate lines and to respective data lines crossing the gate lines which are formed on the display panel. Such a display apparatus may further include a gate driver circuit for outputting gate signals to the gate lines and a data driver circuit for outputting data signals to the data lines. Recently, various research projects on a display panel including horizontal pixels, in which the data lines extend in a direction in parallel with a shorter side of each pixel, have been conducted.

SUMMARY

Exemplary embodiments of the disclosure provide a display apparatus with improved display quality.

Exemplary embodiments of the disclosure provide a method of operating the display apparatus.

According to exemplary embodiments, a display apparatus includes a gate driving control circuit, a gate driver and a display panel. In such an embodiment, the gate driving control circuit generates N gate clock signals and N inversion gate clock signals based on N gate clock control signals, where N is a natural number greater than or equal to two, phases of the N gate clock signals partially overlap with each other, and each of the N inversion gate clock signals has a phase opposite to a phase of a respective one of the N gate clock signals. In such an embodiment, the gate driver generates a plurality of gate signals based on the N gate clock signals or the N inversion gate clock signals, and applies the plurality of gate signals to a plurality of gate lines. In such an embodiment, the display panel includes a plurality of pixels each of which is connected to a respective one of the plurality of gate lines and a respective one of a plurality of data lines. In such an embodiment, each of the plurality of pixels has a longer side in parallel with the plurality of gate lines and a shorter side in parallel with the plurality of data line, and a number of the gate clock control signals is an integer multiple of a number of colors of the plurality of pixels.

In an exemplary embodiment, gate signals to be applied to gate lines connected to pixels having a same color may be generated based on a same gate clock control signal.

In an exemplary embodiment, the plurality of pixels may include a plurality of red pixels which outputs red light, a plurality of green pixels which outputs green light and a plurality of blue pixels which outputs blue light. In such an embodiment, the number of the gate clock control signals may be a multiple of three, and each of a number of the gate clock signals and a number of the inversion gate clock signals may be substantially equal to the number of the gate clock control signals.

In an exemplary embodiment, the plurality of red pixels may include a first red pixel connected to a first gate line, the plurality of green pixels may include a first green pixel connected to a second gate line, and the plurality of blue pixels may include a first blue pixel connected to a third gate line. In such an embodiment, the first, second and third gate lines may be adjacent to each other, the gate driver may generate first, second and third gate signals based on first, second and third gate clock signals, and each of the first, second and third gate signals may be applied to a respective one of the first, second and third gate lines.

In an exemplary embodiment, the plurality of red pixels may further include a second red pixel connected to a fourth gate line, the plurality of green pixels may further include a second green pixel connected to a fifth gate line, and the plurality of blue pixels may further include a second blue pixel connected to a sixth gate line. In such an embodiment, the fourth, fifth and sixth gate lines may be adjacent to each other. In such an embodiment, the number of the gate clock control signals is three, the gate driver may generate fourth, fifth and sixth gate signals based on first, second and third inversion gate clock signals, and each of the fourth, fifth and sixth gate signals may be applied to a respective one of the fourth, fifth and sixth gate lines.

In an exemplary embodiment, an arrangement of the second red pixel, the second green pixel and the second blue pixel may be substantially the same as an arrangement of the first red pixel, the first green pixel and the first blue pixel.

In an exemplary embodiment, an arrangement of the second red pixel, the second green pixel and the second blue pixel may be different from an arrangement of the first red pixel, the first green pixel and the first blue pixel.

In an exemplary embodiment, each of the first red pixel, the first green pixel and the first blue pixel may be connected to a respective data line, which is located at a first side of a respective one of the first red pixel, the first green pixel and the first blue pixel. Each of the second red pixel, the second green pixel and the second blue pixel may be connected to a respective data line, which is located at a second side of a respective one of the second red pixel, the second green pixel and the second blue pixel. The second side may be opposite to the first side.

In an exemplary embodiment, the plurality of red pixels may further include a second red pixel connected to a fourth gate line, the plurality of green pixels may further include a second green pixel connected to a fifth gate line, and the plurality of blue pixels may further include a second blue pixel connected to a sixth gate line. In such an embodiment, the fourth, fifth and sixth gate lines may be adjacent to each other. In such an embodiment, the number of the gate clock control signals is six, the gate driver may generate fourth, fifth and sixth gate signals based on fourth, fifth and sixth gate clock signals, and each of the fourth, fifth and sixth gate signals may be applied to a respective one of the fourth, fifth and sixth gate lines.

In an exemplary embodiment, the plurality of pixels may include a plurality of red pixels which outputs red light, a plurality of green pixels which outputs green light, a plurality of blue pixels which outputs blue light and a plurality of white pixels which outputs white light. In such an embodiment, the number of the gate clock control signals may be a multiple of four, and each of a number of the gate clock signals and a number of the inversion gate clock signals may be substantially equal to the number of the gate clock control signals.

In an exemplary embodiment, the plurality of red pixels may include a first red pixel connected to a first gate line, the plurality of green pixels may include a first green pixel connected to a second gate line, the plurality of blue pixels may include a first blue pixel connected to a third gate line, and the plurality of white pixels may include a first white pixel connected to a fourth gate line. In such an embodiment, the first, second, third and fourth gate lines may be adjacent to each other. In such an embodiment, the gate driver may generate first, second, third and fourth gate signals based on first, second, third and fourth gate clock signals, and each of the first, second, third and fourth gate signals may be applied to a respective one of the first, second, third and fourth gate lines.

In an exemplary embodiment, the plurality of red pixels may further include a second red pixel connected to a fifth gate line, the plurality of green pixels may further include a second green pixel connected to a sixth gate line, the plurality of blue pixels may further include a second blue pixel connected to a seventh gate line, and the plurality of white pixels may further include a second white pixel connected to an eighth gate line. In such an embodiment, the fifth, sixth, seventh and eighth gate lines may be adjacent to each other. In such an embodiment, the number of the gate clock control signals is four, the gate driver may generate fifth, sixth, seventh and eighth gate signals based on first, second, third and fourth inversion gate clock signals, and each of the fifth, sixth, seventh and eighth gate signals may be applied to a respective one of the fifth, sixth, seventh and eighth gate lines.

In an exemplary embodiment, the plurality of red pixels may further include a second red pixel connected to a fifth gate line, the plurality of green pixels may further include a second green pixel connected to a sixth gate line, the plurality of blue pixels may further include a second blue pixel connected to a seventh gate line, and the plurality of white pixels may further include a second white pixel connected to an eighth gate line. In such an embodiment, the fifth, sixth, seventh and eighth gate lines may be adjacent to each other. In such an embodiment, the number of the gate clock control signals is eight, the gate driver may generate fifth, sixth, seventh and eighth gate signals based on fifth, sixth, seventh and eighth gate clock signals, and each of the fifth, sixth, seventh and eighth gate signals may be applied to a respective one of the fifth, sixth, seventh and eighth gate lines.

In an exemplary embodiment, the gate driving control circuit may include N level shifters. In such an embodiment, each of the N level shifters may generate a respective one of the N gate clock signals and a respective one of the N inversion gate clock signals based on a respective one of the N gate clock control signals and a respective one of N charge sharing control signals.

In an exemplary embodiment, a first level shifter among the N level shifters includes a first p-type metal oxide semiconductor ("PMOS") transistor, a first n-type metal oxide semiconductor ("NMOS") transistor, a second PMOS transistor, a second NMOS transistor, a third PMOS transistor and a fourth PMOS transistor. In such an embodiment, the first PMOS transistor may be connected between a gate-on voltage and a first output terminal which outputs a first gate clock signal and may have a gate electrode which receives a first gate clock control signal. In such an embodiment, the first NMOS transistor may be connected between a gate-off voltage and the first output terminal and may have a gate electrode which receives the first gate clock control signal. In such an embodiment, the second PMOS transistor may be connected between the gate-on voltage and a second output terminal which outputs a first inversion gate clock signal and may have a gate electrode which receives a first inversion gate clock control signal. In such an embodiment, the second NMOS transistor may be connected between the gate-off voltage and the second output terminal and may have a gate electrode which receives the first inversion gate clock control signal. In such an embodiment, the third and fourth PMOS transistors may be connected in series between the first output terminal and the second output terminal. In such an embodiment, each of the third and fourth PMOS transistors may have a gate electrode which receives a first charge sharing control signal.

In an exemplary embodiment, the plurality of pixels may be arranged in a display region of the display panel. In such an embodiment, the gate driver may be disposed in a peripheral region of the display panel surrounding the display region of the display panel.

According to exemplary embodiments, a method of operating a display apparatus including the display panel, the display panel includes a plurality of pixels each of which is connected to a respective one of a plurality of gate lines and a respective one of a plurality of data lines Includes: generating N gate clock signals and N inversion gate clock signals based on N gate clock control signals, where N is a natural number greater than or equal to two, phases of the N gate clock signals partially overlap with each other, and each of the N inversion gate clock signals has a phase opposite to that of a respective one of the N gate clock signals; generating a plurality of gate signals based on the N gate clock signals or the N inversion gate clock signals; and applying the plurality of gate signals to the plurality of gate lines. In such an embodiment, each of the plurality of pixels has a longer side in parallel with the plurality of gate lines and a shorter side in parallel with the plurality of data lines, and a number of the gate clock control signals is an integer multiple of a number of colors of the plurality of pixels.

In an exemplary embodiment, gate signals to be applied to gate lines connected to pixels having a same color may be generated based on a same gate clock control signal.

In an exemplary embodiment, the plurality of pixels may include a plurality of red pixels which outputs red light, a plurality of green pixels which outputs green light and a plurality of blue pixels which outputs blue light. In such an embodiment, the number of the gate clock control signals may be a multiple of three, and each of a number of the gate clock signals and a number of the inversion gate clock signals may be substantially equal to the number of the gate clock control signals.

In an exemplary embodiment, the plurality of pixels may include a plurality of red pixels which outputs red light, a plurality of green pixels which outputs green light, a plurality of blue pixels which outputs blue light and a plurality of white pixels which outputs white light. In such an embodiment, the number of the gate clock control signals may be a multiple of four, and each of a number of the gate clock signals and a number of the inversion gate clock signals may be substantially equal to the number of the gate clock control signals.

In exemplary embodiments of the display apparatus, the plurality of gate clock signals and the plurality of gate signals may be generated based on the plurality of gate clock control signals, and the number of the gate clock control signals and the number of the gate clock signals may be an integer multiple of the number of colors of the plurality of pixels. In such embodiments, the gate lines that are connected to the pixels having a same color may operate or may be driven based on a same gate clock control signal. Accordingly, a difference of charging rates due to an output deviation of the gate clock control signals and/or a horizontal spot on the display panel due to the difference of the charging rates may be effectively prevented.

BRIEF DESCRIPTION OF THE DRAWINGS

Illustrative, non-limiting exemplary embodiments will be more clearly understood from the following detailed description taken in conjunction with the accompanying drawings.

DETAILED DESCRIPTION

Figure 1:
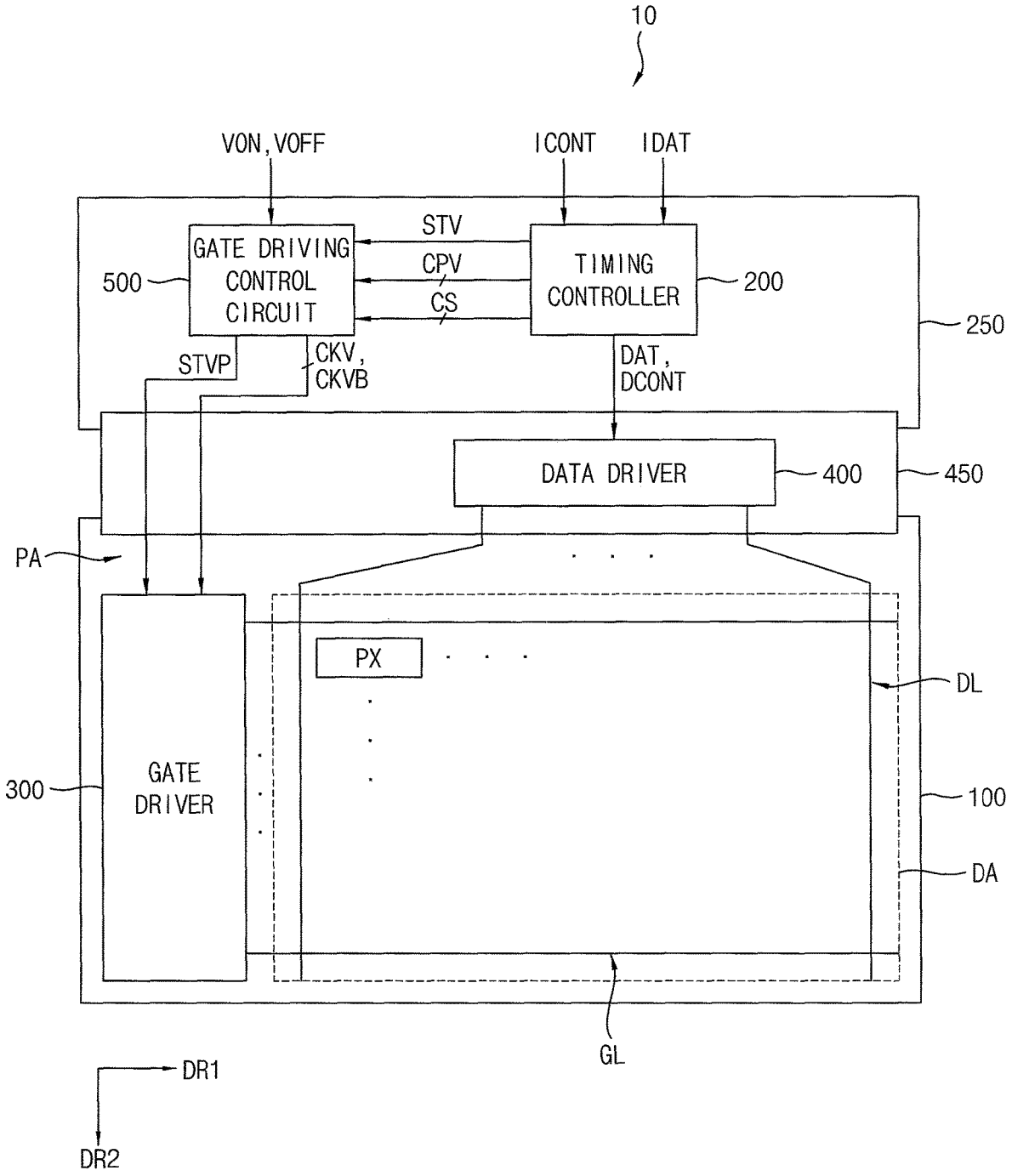
FIG. 1 is a block diagram illustrating a display apparatus according to exemplary embodiments.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system).

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Hereinafter, exemplary embodiments of the invention will be described more fully hereinafter with reference to the accompanying drawings.

FIG. 1 is a block diagram illustrating a display apparatus according to exemplary embodiments.

Referring to FIG. 1, an exemplary embodiment of a display apparatus 10 includes a display panel 100, a timing controller 200, a gate driver 300, a data driver 400 and a gate driving control circuit 500. The display apparatus 10 may further include a printed circuit board ("PCB") 250 and a flexible PCB ("FPCB") 450.

The display panel 100 operates (e.g., display an image) based on output image data DAT. The display panel 100 is connected to a plurality of gate lines GL and a plurality of data lines DL. The gate lines GL may extend in a first direction DR1, and the data lines DL may extend in a second direction DR2 crossing (e.g., substantially perpendicular to) the first direction DR1. The display panel 100 may include a display region DA and a peripheral region PA. The display region DA may include a plurality of pixels PX that are arranged in a matrix form. Each of the pixels PX may be electrically connected to a respective one of the gate lines GL and a respective one of the data lines DL. The peripheral region PA may surround the display region DA.

Each of the plurality of pixels PX has a longer side (e.g., a relatively long side) in parallel with the gate lines GL and a shorter side (e.g., a relatively short side) in parallel with the data lines DL. In such an embodiment, each of the pixels PX may be implemented with a horizontal pixel structure in which a longer side extends in the first direction DR1 in parallel with the gate lines GL and a shorter side extends in the second direction DR2 in parallel with the data lines DL.

The timing controller 200 controls operations of the display panel 100, the gate driver 300, the data driver 400 and the gate driving control circuit 500. The timing controller 200 receives input image data IDAT and an input control signal ICONT from an external device (e.g., a host or a graphic processor). The input image data IDAT may include a plurality of pixel data for the plurality of pixels PX. The input control signal ICONT may include a master clock signal, a data enable signal, a vertical synchronization signal, a horizontal synchronization signal, etc.

The timing controller 200 generates the output image data DAT based on the input image data IDAT. In one exemplary embodiment, for example, the timing controller 200 may selectively perform an image quality compensation, a spot compensation, an adaptive color correction ("ACC"), and/or a dynamic capacitance compensation ("DCC") on the input image data IDAT to generate the output image data DAT. The timing controller 200 generates a first control signal for controlling the gate driving control circuit 500 and the gate driver 300 and a second control signal DCONT for controlling the data driver 400, based on the input control signal ICONT. In one exemplary embodiment, for example, the first control signal may include a vertical start control signal STV, N gate clock control signals CPV, N charge sharing control signals CS, etc. Here, N is a natural number greater than or equal to two. The second control signal DCONT may include a horizontal start signal, a data clock signal, a polarity control signal, a data load signal, etc.

The gate driving control circuit 500 generates N gate clock signals CKV and N inversion gate clock signals CKVB, based on the N gate clock control signals CPV. As will be described with reference to FIGS. 6 and 13, phases of the N gate clock signals CKV partially overlap with each other, and each of the N inversion gate clock signals CKVB has a phase opposite to that of a respective one of the N gate clock signals CKV. The gate driving control circuit 500 may generate a vertical start pulse STVP based on the vertical start control signal STV. In an exemplary embodiment, the N charge sharing control signals CS may be further used for generating the N gate clock signals CKV and the N inversion gate clock signals CKVB, and a gate-on voltage VON and a gate-off voltage VOFF that are received from an external circuit (e.g., a power supply or a voltage generator) may be further used for generating the N gate clock signals CKV, the N inversion gate clock signals CKVB and the vertical start pulse STVP. The gate driving control circuit 500 may be referred to as a power management integrated circuit ("PMIC").

The gate driver 300 is connected to the display panel 100 through the gate lines GL. The gate driver 300 generates a plurality of gate signals for driving the display panel 100 based on the N gate clock signals CKV and/or the N inversion gate clock signals CKVB. In one exemplary embodiment, for example, the gate driver 300 may sequentially provide or apply the gate signals to the display panel 100 through the gate lines GL. In such an embodiment, the vertical start pulse STVP may be further used for generating the gate signals.

The data driver 400 is connected to the display panel 100 through the data lines DL. The data driver 400 generates a plurality of data voltages (e.g., analog voltages) for driving the display panel 100 based on the output image data DAT (e.g., digital data) and the second control signal DCONT. In one exemplary embodiment, for example, the data driver 400 may sequentially provide or apply the data voltages to a plurality of lines (e.g., horizontal lines) in the display panel 100 through the data lines DL.

In some exemplary embodiments, the gate driver 300 may be an amorphous silicon gate ("ASG") unit that is integrated in the display panel 100. In one exemplary embodiment, for example, the gate driver 300 may be disposed on the peripheral region PA of the display panel 100, and may be adjacent to a first side (e.g., a relatively short side on the left) of the display panel 100. In alternative exemplary embodiments, although not illustrated in FIG. 1, the gate driver may be disposed at any region that is located outside the display panel.

In some exemplary embodiments, the timing controller 200 and the gate driving control circuit 500 may be disposed, e.g., mounted, on the PCB 250, and the data driver 400 may be disposed, e.g., mounted, on the FPCB 450. The FPCB 450 may electrically connect the PCB 250 with the display panel 100. In one exemplary embodiment, for example, the PCB 250 and the FPCB 450 may be electrically connected by an anisotropic conductive film ("ACF"), and the FPCB 450 and the display panel 100 may be electrically connected by the ACF. In one exemplary embodiment, for example, the FPCB 450 may be adjacent to a second side (e.g., a relatively long side on the upper) of the display panel 100 crossing the first side of the display panel 100.

In an exemplary embodiment of the display apparatus 10, the number of the gate clock control signals CPV (e.g., N) is an integer multiple of the number of colors of the plurality of pixels PX. In some exemplary embodiments, where each of the pixels PX has one of three different colors (e.g., when the number of colors of the pixels PX is three), the number of the gate clock control signals CPV may be a multiple of three. In other exemplary embodiments, where each of the pixels PX has one of four different colors (e.g., when the number of colors of the pixels PX is four), the number of the gate clock control signals CPV may be a multiple of four. In such an embodiment, gate signals to be applied to gate lines connected to pixels having a same color as each other may be generated based on a same gate clock control signal. In such an embodiment, each of the number of the gate clock signals CKV and the number of the inversion gate clock signals CKVB may be substantially equal to the number of the gate clock control signals CPV.

Figure 2:
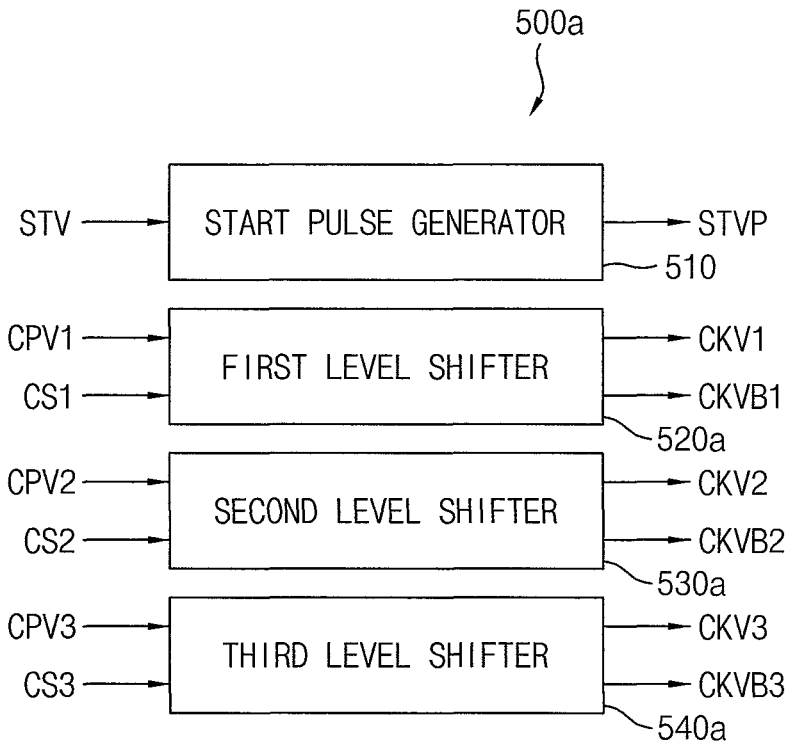
FIG. 2 is a block diagram illustrating an exemplary embodiment of a gate driving control circuit included in a display apparatus.

FIG. 2 is a block diagram illustrating an exemplary embodiment of a gate driving control circuit included in a display apparatus.

Referring to FIG. 2, a gate driving control circuit 500*a* may include a start pulse generator 510, a first level shifter 520*a*, a second level shifter 530*a* and a third level shifter 540*a*.

The start pulse generator 510 may generate the vertical start pulse STVP based on the vertical start control signal STV.

The first level shifter 520*a* may generate a first gate clock signal CKV1 and a first inversion gate clock signal CKVB1 based on a first gate clock control signal CPV1 and a first charge sharing control signal CS1. The second level shifter 530*a* may generate a second gate clock signal CKV2 and a second inversion gate clock signal CKVB2 based on a second gate clock control signal CPV2 and a second charge sharing control signal CS2. The third level shifter 540*a* may generate a third gate clock signal CKV3 and a third inversion gate clock signal CKVB3 based on a third gate clock control signal CPV3 and a third charge sharing control signal CS3.

In an exemplary embodiment, the gate driving control circuit 500*a* may generate three gate clock signals CKV1-CKV3 and three inversion gate clock signal CKVB1-CKVB3 based on three gate clock control signals CPV1-CPV3. Thus, the gate driving control circuit 500*a* may be employed or adopted to a display apparatus in which each of the pixels has one of three different colors.

In some exemplary embodiments, as will be described with reference to FIG. 5, a plurality of pixels of a display apparatus including the gate driving control circuit 500*a* may include a plurality of red pixels that outputs red light, a plurality of green pixels that outputs green light and a plurality of blue pixels that outputs blue light. In other exemplary embodiments, although not illustrated in FIG. 5, a plurality of pixels of a display apparatus including the gate driving control circuit 500*a* may include a plurality of yellow pixels that outputs yellow light, a plurality of cyan pixels that outputs cyan light and a plurality of magenta pixels that outputs magenta light. In still other exemplary embodiments, a plurality of pixels of a display apparatus including the gate driving control circuit 500*a* may have any three different colors.

Figure 3:
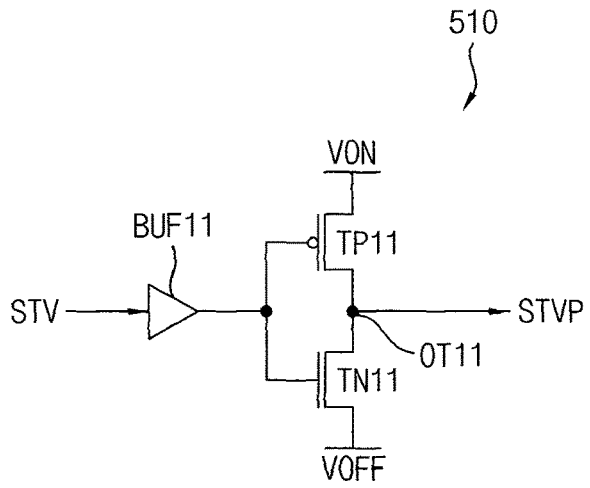
FIG. 3 is a circuit diagram illustrating an exemplary embodiment of a start pulse generator included in the gate driving control circuit of FIG. 2.

FIG. 3 is a circuit diagram illustrating an exemplary embodiment of a start pulse generator included in the gate driving control circuit of FIG. 2.

Referring to FIG. 3, an exemplary embodiment of the start pulse generator 510 may include a first buffer BUF11, a first p-type metal oxide semiconductor ("PMOS") transistor TP11 and a first n-type metal oxide semiconductor ("NMOS") transistor TN11.

The first buffer BUF11 may receive, buffer and output the vertical start control signal STV. The first PMOS transistor TP11 may be connected between the gate-on voltage VON and a first output terminal OT11 and may have a gate electrode that receives the vertical start control signal STV output from the first buffer BUF11. The first NMOS transistor TN11 may be connected between the first output terminal OT11 and the gate-off voltage VOFF and may have a gate electrode that receives the vertical start control signal STV output from the first buffer BUF11. The vertical start pulse STVP that represents a starting point of an operation of the gate driver 300 in FIG. 1 may be output from the first output terminal OT11.

Figure 4A:
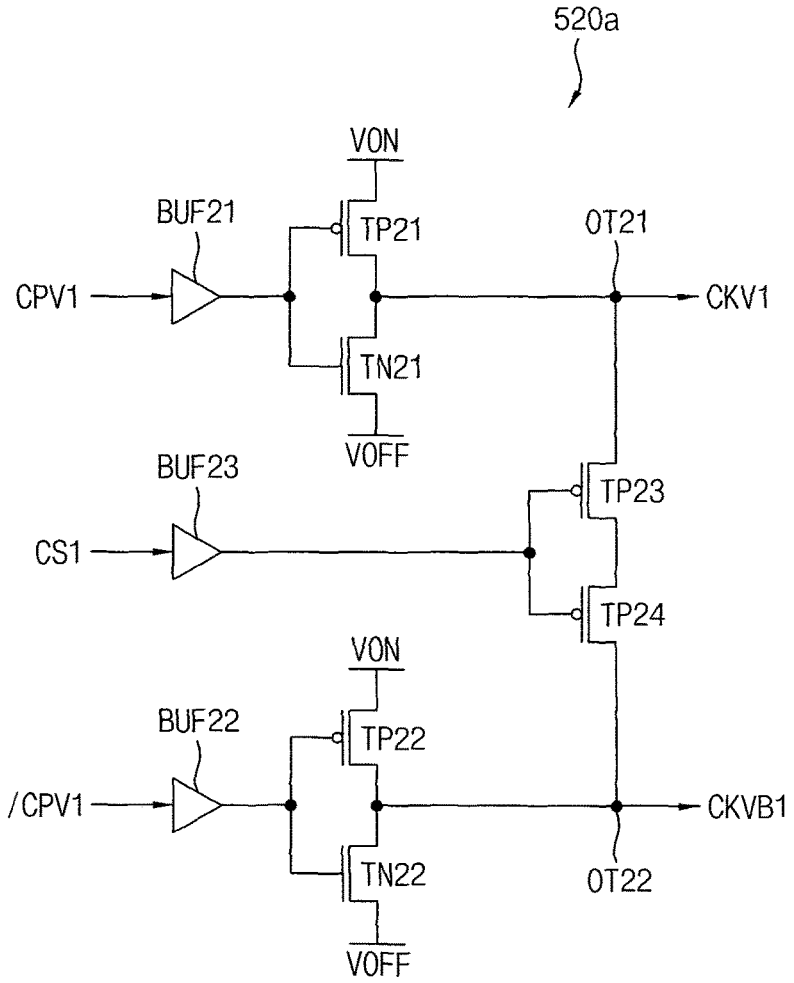
FIG. 4A is a circuit diagram illustrating an exemplary embodiment of a first level shifter included in the gate driving control circuit of FIG. 2.
Figure 4B:
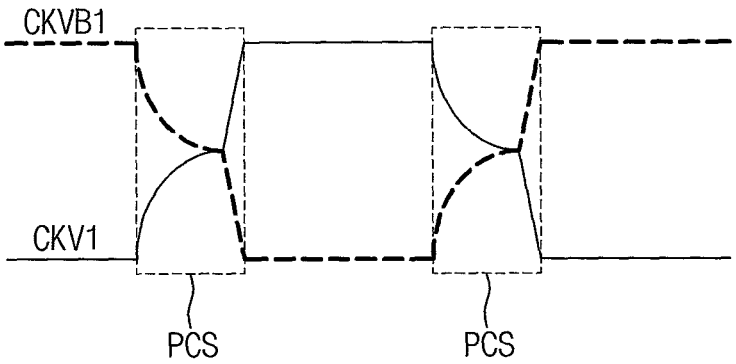
FIG. 4B is a diagram illustrating an operation of the first level shifter of FIG. 4A.

FIG. 4A is a circuit diagram illustrating an exemplary embodiment of a first level shifter included in the gate driving control circuit of FIG. 2. FIG. 4B is a diagram illustrating an operation of the first level shifter of FIG. 4A.

Referring to FIGS. 4A and 4B, an exemplary embodiment of the first level shifter 520*a* may include a first buffer BUF21, a second buffer BUF22, a third buffer BUF23, a first PMOS transistor TP21, a second PMOS transistor TP22, a third PMOS transistor TP23, a fourth PMOS transistor TP24, a first NMOS transistor TN21 and a second NMOS transistor TN22.

The first buffer BUF21 may receive, buffer and output the first gate clock control signal CPV1. The second buffer BUF22 may receive, buffer and output the first inversion gate clock control signal /CPV1, which has a phase opposite to that of the first gate clock control signal CPV1. The third buffer BUF23 may receive, buffer and output the first charge sharing control signal CS1.

The first PMOS transistor TP21 may be connected between the gate-on voltage VON and a first output terminal OT21, and may have a gate electrode that receives the first gate clock control signal CPV1 output from the first buffer BUF21. The first NMOS transistor TN21 may be connected between the first output terminal OT21 and the gate-off voltage VOFF, and may have a gate electrode that receives the first gate clock control signal CPV1 output from the first buffer BUF21. The second PMOS transistor TP22 may be connected between the gate-on voltage VON and a second output terminal OT22, and may have a gate electrode that receives the first inversion gate clock control signal /CPV1 output from the second buffer BUF22. The second NMOS transistor TN22 may be connected between the second output terminal OT22 and the gate-off voltage VOFF, and may have a gate electrode that receives the first inversion gate clock control signal /CPV1 output from the second buffer BUF22. The first gate clock signal CKV1 may be output from the first output terminal OT21, and the first inversion gate clock signal CKVB1 may be output from the second output terminal OT22.

The third PMOS transistor TP23 and the fourth PMOS transistor TP24 may be connected in series between the first output terminal OT21 and the second output terminal OT22. Each of the third PMOS transistor TP23 and the fourth PMOS transistor TP24 may have a gate electrode that receives the first charge sharing control signal CS1 output from the third buffer BUF23.

In such an embodiment, as illustrated in FIG. 4B, each of the first gate clock signal CKV1 and the first inversion gate clock signal CKVB1 that are generated by the first level shifter 520*a* may swing between a high level and a low level, and the first inversion gate clock signal CKVB1 may have a phase opposite to that of the first gate clock signal CKV1. In one exemplary embodiment, for example, while the first gate clock signal CKV1 has the low level, the first inversion gate clock signal CKVB1 may have the high level. In such an embodiment, while the first gate clock signal CKV1 and the first inversion gate clock signal CKVB1 are transitioned from one of the high level and the low level to the other of the high level and the low level, a charge sharing operation may be performed during a charge sharing period PCS that is activated based on the first charge sharing control signal CS1.

In an exemplary embodiment, although not illustrated in FIG. 4A, each of the second level shifter 530*a* and the third level shifter 540*a* in FIG. 2 may have a configuration substantially the same as that of the first level shifter 520*a* of FIG. 4A. In an exemplary embodiment, although not illustrated in FIG. 4B, each of the second gate clock signal CKV2 and the second inversion gate clock signal CKVB2 that are generated from the second level shifter 530*a*, and each of the third gate clock signal CKV3 and the third inversion gate clock signal CKVB3, which are generated from the third level shifter 540*a*, may have phases similar to those of the first gate clock signal CKV1 and the first inversion gate clock signal CKVB1 in FIG. 4B.

In some exemplary embodiments, a configuration for performing the charge sharing operation (e.g., the first charge sharing control signal CS1, the third buffer BUF23, the third PMOS transistor TP23 and the fourth PMOS transistor TP24 in FIG. 4A) may be omitted.

Figure 5:
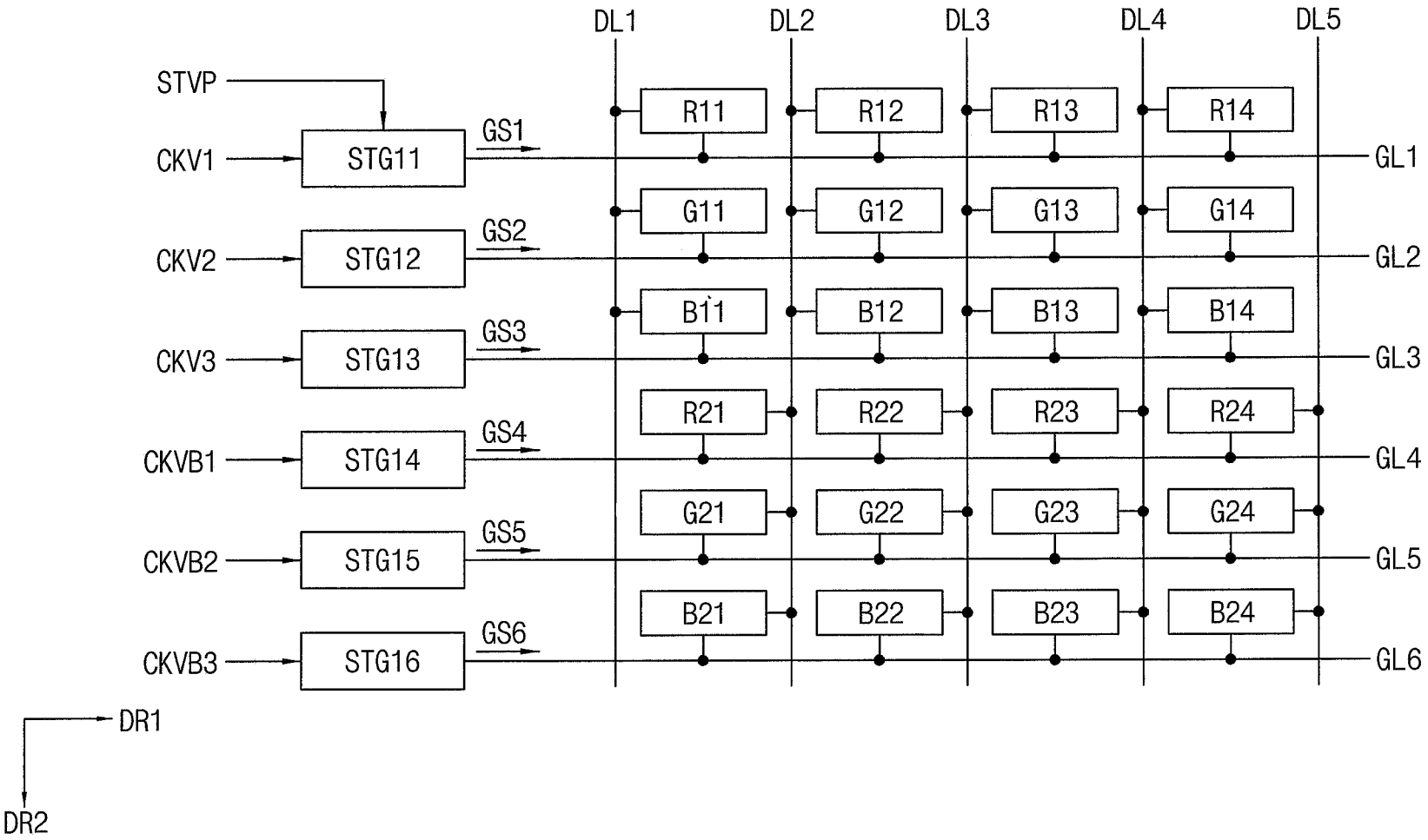
FIGS. 5, 6 and 7 are diagrams illustrating an operation of a display apparatus including the gate driving control circuit of FIG. 2.
Figure 6:
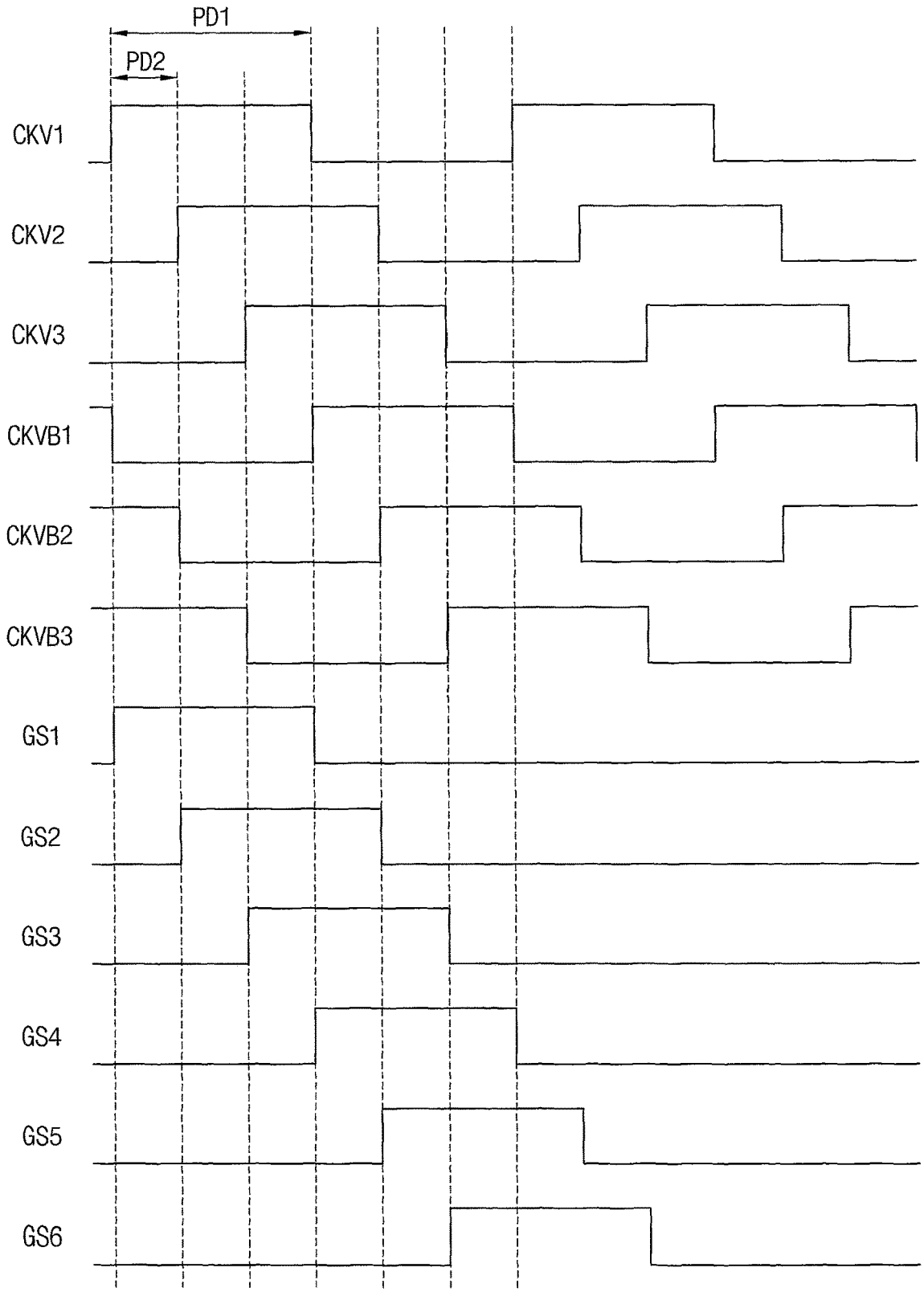
Figure 7:
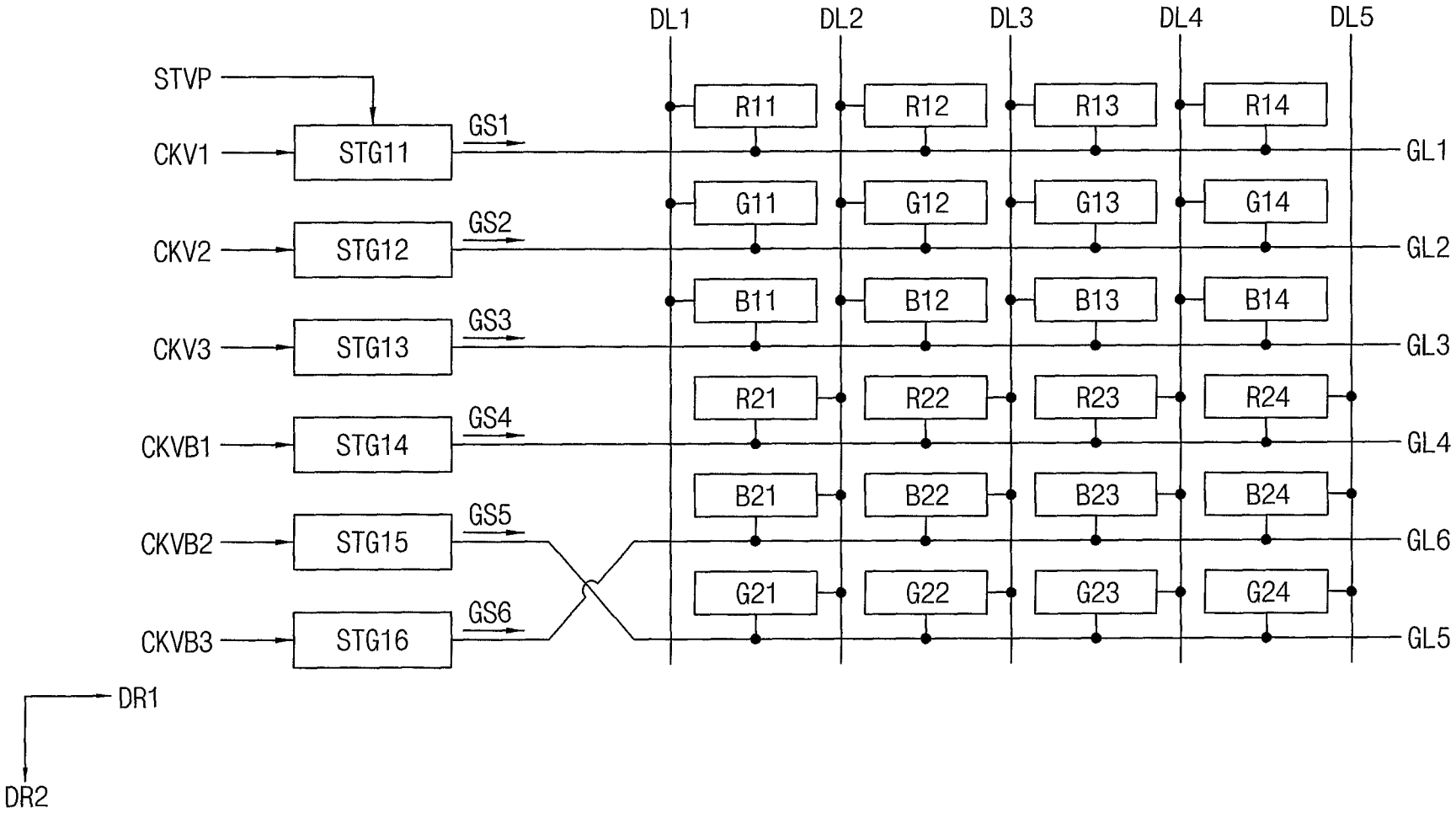

FIGS. 5, 6 and 7 are diagrams illustrating an operation of a display apparatus including the gate driving control circuit of FIG. 2.

Referring to FIGS. 2 and 5, in an exemplary embodiment, a display panel (e.g., the display panel 100 in FIG. 1) may include a plurality of pixels R11, R12, R13, R14, R21, R22, R23, R24, G11, G12, G13, G14, G21, G22, G23, G24, B11, B12, B13, B14, B21, B22, B23 and B24. Each pixel may be connected to a respective one of data lines DL1, DL2, DL3, DL4 and DL5 and a respective one of gate lines GL1, GL2, GL3, GL4, GL5 and GL6. The plurality of pixels may include a plurality of red pixels R11-R14 and R21-R24, a plurality of green pixels G11-G14 and G21-G24, and a plurality of blue pixels B11-B14 and B21-B24.

In an exemplary embodiment of FIG. 5, each pixel may be connected to a respective one gate line that is located at a lower side of each pixel. In one exemplary embodiment, for example, each of the first red pixels R11-R14 in a first pixel row may be connected to the first gate line GL1. Each of the first green pixels G11-G14 in a second pixel row may be connected to the second gate line GL2. Each of the first blue pixels B11-B14 in a third pixel row may be connected to the third gate line GL3. Each of the second red pixels R21-R24 in a fourth pixel row may be connected to the fourth gate line GL4. Each of the second green pixels G21-G24 in a fifth pixel row may be connected to the fifth gate line GL5. Each of the second blue pixels B21-B24 in a sixth pixel row may be connected to the sixth gate line GL6.

Each of the first red pixels R11-R14, the first green pixels G11-G14 and the first blue pixels B11-B14 may be connected to a respective data line that is located at a first side (e.g., a left side) of each pixel, and each of the second red pixels R21-R24, the second green pixels G21-G24 and the second blue pixels B21-B24 may be connected to a respective data line that is located at a second side (e.g., a right side) of each pixel. In one exemplary embodiment, for example, some of the pixels R11, G11 and B11 in a first pixel column may be connected to the first data line DL1. In such an embodiment, some of the pixels R21, G21 and B21 in the first pixel column and the pixels R12, G12 and B12 in a second pixel column may be connected to the second data line DL2. Some of the pixels R22, G22 and B22 in the second pixel column and the pixels R13, G13 and B13 in a third pixel column may be connected to the third data line DL3. In such an embodiment, some of the pixels R23, G23 and B23 in the third pixel column and the pixels R14, G14 and B14 in a fourth pixel column may be connected to the fourth data line DL4. In such an embodiment, some of the pixels R24, G24 and B24 in the fourth pixel column may be connected to the fifth data line DL5.

In an exemplary embodiment of FIG. 5, the gate lines GL1-GL6 may be connected to the plurality of pixels based on a non-alternate scheme, and the data lines DL1-DL5 may be connected to the plurality of pixels based on an alternate scheme. The non-alternate scheme may represent a scheme in which a particular gate line (or a particular data line) is connected to pixels disposed in a single pixel row (or a single pixel column). The alternate scheme may represent a scheme in which two or more gate lines (or two or more data lines) are connected to pixels disposed in a single pixel row (or a single pixel column). In other words, when the gate lines GL1-GL6 are connected to the plurality of pixels based on the non-alternate scheme, a particular gate line may be connected to pixels disposed at a single side (e.g., only an upper side or a lower side) with respect to the particular gate line. When the data lines DL1-DL5 are connected to the plurality of pixels based on the alternate scheme, a data line may be connected to pixels disposed at both sides thereof (e.g., both left and right sides). The exemplary embodiment of FIG. 5 may be referred to as a data line alternate scheme with three-dot horizontal pixels.

A gate driver (e.g., the gate driver 300 in FIG. 1) may include a plurality of stages STG11, STG12, STG13, STG14, STG15 and STG16. Each stage may generate a respective one of gate signals GS1, GS2, GS3, GS4, GS5 and GS6 for driving a respective one of the gate lines GL1-GL6 based on a respective one of the gate clock signals CKV1-CKV3 and the inversion gate clock signals CKVB1-CKVB3.

In an exemplary embodiment of FIG. 5, the first stage STG11 may generate the first gate signal GS1 to be applied to the first gate line GL1 based on the vertical start pulse STVP and the first gate clock signal CKV1. The second stage STG12 may generate the second gate signal GS2 to be applied to the second gate line GL2 based on the second gate clock signal CKV2. The third stage STG13 may generate the third gate signal GS3 to be applied to the third gate line GL3 based on the third gate clock signal CKV3. The fourth stage STG14 may generate the fourth gate signal GS4 to be applied to the fourth gate line GL4 based on the first inversion gate clock signal CKVB1. The fifth stage STG15 may generate the fifth gate signal GS5 to be applied to the fifth gate line GL5 based on the second inversion gate clock signal CKVB2. The sixth stage STG16 may generate the sixth gate signal GS6 to be applied to the sixth gate line GL6 based on the third inversion gate clock signal CKVB3.

In some exemplary embodiments, although not illustrated in FIG. 5, the plurality of stages may be cascade-connected with each other such that an output of a previous stage is provided as an input of a next stage. In one exemplary embodiment, for example, the first gate signal GS1 output from the first stage STG11 may be provided to the second stage STG12. In such an embodiment, the second gate signal GS2 output from the second stage STG12 may be provided to the third stage STG13, the third gate signal GS3 output from the third stage STG13 may be provided to the fourth stage STG14, the fourth gate signal GS4 output from the fourth stage STG14 may be provided to the fifth stage STG15, and the fifth gate signal GS5 output from the fifth stage STG15 may be provided to the sixth stage STG16.

In some exemplary embodiments, gate lines connected to pixels having a same color may operate or may be driven based on a same gate clock control signal. In an exemplary embodiment, gate signals that are applied to the gate lines connected to the pixels having the same color may be generated based on the same gate clock control signal. In one exemplary embodiment, for example, the gate signals GS1 and GS4 to be applied to the gate lines GL1 and GL4 connected to the red pixels R11-R14 and R21-R24 may be generated based on the clock signals CKV1 and CKVB1 that are generated based on the first gate clock control signal CPV1. In such an embodiment, the gate signals GS2 and GS5 to be applied to the gate lines GL2 and GL5 connected to the green pixels G11-G14 and G21-G24 may be generated based on the clock signals CKV2 and CKVB2 that are generated based on the second gate clock control signal CPV2, and the gate signals GS3 and GS6 to be applied to the gate lines GL3 and GL6 connected to the blue pixels B11-B14 and B21-B24 may be generated based on the clock signals CKV3 and CKVB3 that are generated based on the third gate clock control signal CPV3.

In an exemplary embodiment of the display apparatus, gate lines (e.g., the gate lines GL1 and GL4) that are connected to pixels having a same color (e.g., the red pixels R11-R14 and R21-R24) may operate or may be driven based on clock signals (e.g., the clock signals CKV1 and CKVB1) that are generated for a same charge sharing operation. Accordingly, in such an embodiment, a duration for charging the pixels may be increased, and a difference of charging rates due to an output deviation of the level shifters and/or a horizontal spot on the display panel due to the difference of the charging rates may be effectively prevented.

In an exemplary embodiment of FIG. 5, an arrangement of the second red pixels R21-R24, the second green pixels G21-G24 and the second blue pixels B21-B24 may be substantially the same as an arrangement of the first red pixels R11-R14, the first green pixels G11-G14 and the first blue pixels B11-B14. In one exemplary embodiment, for example, the pixels R11-R14, G11-G14 and B11-B14 may be arranged in an order of red, green and blue in the second direction DR2, and the pixels R21-R24, G21-G24 and B21-B24 may also be arranged in an order of red, green and blue in the second direction DR2.

Although not illustrated in FIG. 5, a plurality of pixels may be additionally arranged in the first and second directions DR1 and DR2, and a plurality of stages may be additionally arranged in the second direction DR2. In such an embodiment, each of seventh through twelfth gate signals to be applied to a respective one of seventh through twelfth gate lines subsequent to the sixth gate line GL6 may be generated based on a respective one of the gate clock signals CKV1-CKV3 and the inversion gate clock signals CKVB1-CKVB3.

Referring to FIGS. 2 and 6, a phase of one of the gate clock signals CKV1-CKV3 may partially overlap a phase of another gate clock signal, from among the gate clock signals CKV1-CKV3. In one exemplary embodiment, for example, each of the gate clock signals CKV1-CKV3 may have an ON level (e.g., an activation level) for a first period PD1, and two adjacent gate clock signals may have a phase difference by a second period PD2.

In an exemplary embodiment of FIG. 6, a length of the second period PD2 may be about one third of a length of the first period PD1. In one exemplary embodiment, for example, the first period PD1 may correspond to three consecutive horizontal periods (3H), and the second period PD2 may correspond to one horizontal period (1H). In such an embodiment, each of the gate clock signals CKV1-CKV3 may have the ON level for three consecutive horizontal periods, and two adjacent gate clock signals may simultaneously have the ON level for two consecutive horizontal periods.

Each of the inversion gate clock signals CKVB1-CKVB3 may have a phase opposite to that of a respective one of the gate clock signals CKV1-CKV3. Each of the gate signals GS1-GS6 may include a pulse that is included in a respective one of the gate clock signals CKV1-CKV3 and the inversion gate clock signals CKVB1-CKVB3.

Referring to FIGS. 2 and 7, a display panel (e.g., the display panel 100 in FIG. 1) may include a plurality of pixels R11-R14, R21-R24, G11-G14, G21-G24, B11-B14 and B21-B24, and a gate driver (e.g., the gate driver 300 in FIG. 1) may include a plurality of stages STG11-STG16.

An exemplary embodiment of FIG. 7 may be substantially the same as an exemplary embodiment of FIG. 5, except that an arrangement of some pixels G21-G24, B21-B24 and a configuration of some stages STG15 and STG16 and some gate lines GL5 and GL6 are changed in FIG. 7.

In an exemplary embodiment of FIG. 7, an arrangement of the second red pixels R21-R24, the second green pixels G21-G24 and the second blue pixels B21-B24 may be different from an arrangement of the first red pixels R11-R14, the first green pixels G11-G14 and the first blue pixels B11-B14. In one exemplary embodiment, for example, the pixels R11-R14, G11-G14 and B11-B14 may be arranged in an order of red, green and blue in the second direction DR2, and the pixels R21-R24, G21-G24 and B21-B24 may be arranged in an order of red, blue and green in the second direction DR2. In other words, the second green pixels G21-G24 and the second blue pixels B21-B24 may change places with each other, and the fifth gate line GL5 and the sixth gate line GL6 may change places with each other. In such an embodiment, as shown in FIG. 7, the stages STG15 and STG16 may be connected to the gate lines GL5 and GL6 with a cross-coupled structure to connect the fifth stage STG15 and the sixth stage STG16 with the fifth gate line GL5 and the sixth gate line GL6, respectively.

Although not illustrated in FIG. 7, the second red pixels R21-R24, the second green pixels G21-G24 and the second blue pixels B21-B24 may be arranged with any arrangement that is different from the arrangement of the first red pixels R11-R14, the first green pixels G11-G14 and the first blue pixels B11-B14.

Although FIGS. 5 and 7 illustrate exemplary embodiments where the gate lines GL1-GL6 are connected to the pixels based on the non-alternate scheme and the data lines DL1-DL5 are connected to the pixels based on the alternate scheme, the invention is not limited thereto. Alternatively, gate lines may be connected to pixels based on the alternate scheme, and/or data lines may be connected to pixels based on the non-alternate scheme. In an exemplary embodiment, where gate lines are connected to pixels based on the alternate scheme, pixels in a single pixel row may have different colors from each other.

Figure 8:
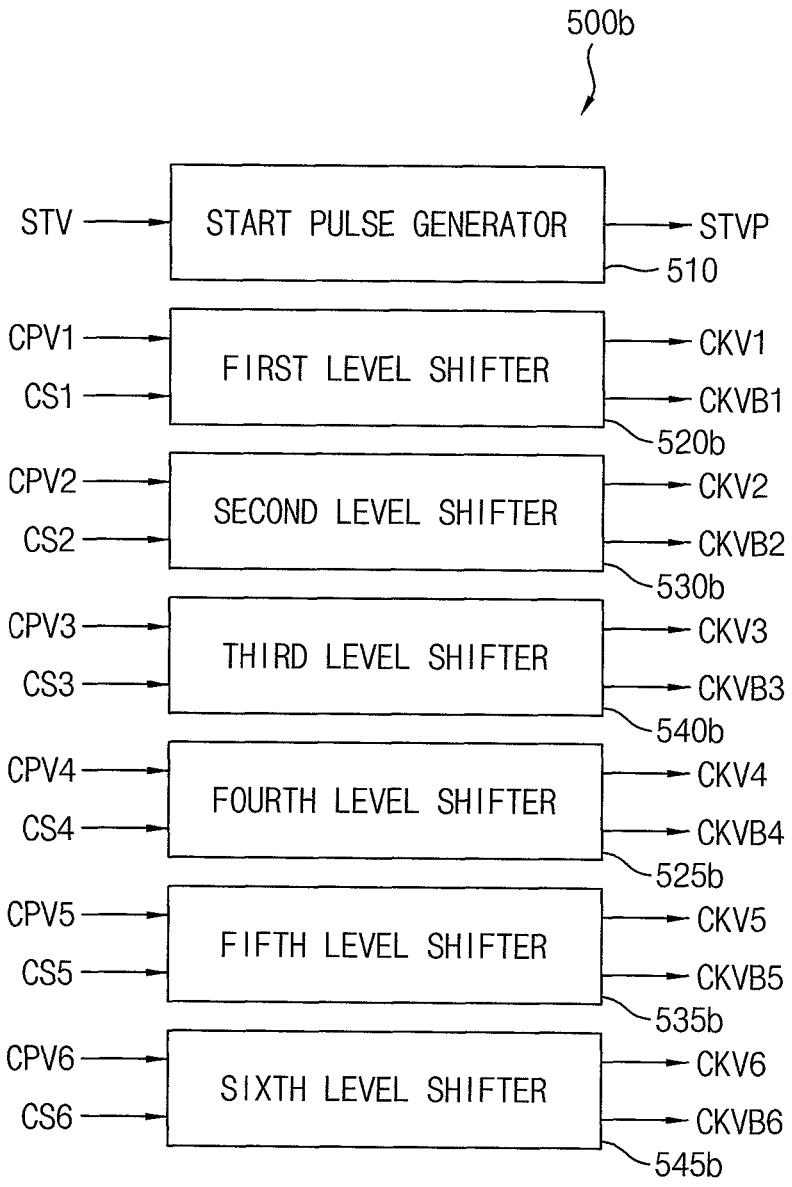
FIG. 8 is a block diagram illustrating another exemplary embodiment of a gate driving control circuit included in a display apparatus.

FIG. 8 is a block diagram illustrating another exemplary embodiment of a gate driving control circuit included in a display apparatus.

Referring to FIG. 8, an exemplary embodiment of a gate driving control circuit 500*b* may include a start pulse generator 510, a first level shifter 520*b*, a second level shifter 530*b*, a third level shifter 540*b*, a fourth level shifter 525*b*, a fifth level shifter 535*b* and a sixth level shifter 545*b*.

The start pulse generator 510 in FIG. 8 may be substantially the same as the start pulse generator 510 in FIG. 2. The first level shifter 520*b*, the second level shifter 530*b* and the third level shifter 540*b* in FIG. 8 may be substantially the same as the first level shifter 520*a*, the second level shifter 530*a* and the third level shifter 540*a* in FIG. 2, respectively.

The fourth level shifter 525*b* may generate a fourth gate clock signal CKV4 and a fourth inversion gate clock signal CKVB4 based on a fourth gate clock control signal CPV4 and a fourth charge sharing control signal CS4. The fifth level shifter 535*b* may generate a fifth gate clock signal CKV5 and a fifth inversion gate clock signal CKVB5 based on a fifth gate clock control signal CPV5 and a fifth charge sharing control signal CS5. The sixth level shifter 545*b* may generate a sixth gate clock signal CKV6 and a sixth inversion gate clock signal CKVB6 based on a sixth gate clock control signal CPV6 and a sixth charge sharing control signal CS6. An operation and a configuration of each of the fourth level shifter 525*b*, the fifth level shifter 535*b* and the sixth level shifter 545*b* may be substantially the same as those of the first level shifter 520*a* described with reference to FIGS. 4A and 4B.

The gate driving control circuit 500*b* may generate six gate clock signals CKV1-CKV6 and six inversion gate clock signal CKVB1-CKVB6 based on six gate clock control signals CPV1-CPV6. Thus, the gate driving control circuit 500*b* may be employed or adopted to a display apparatus in which each of pixels has one of three different colors.

Figure 9:
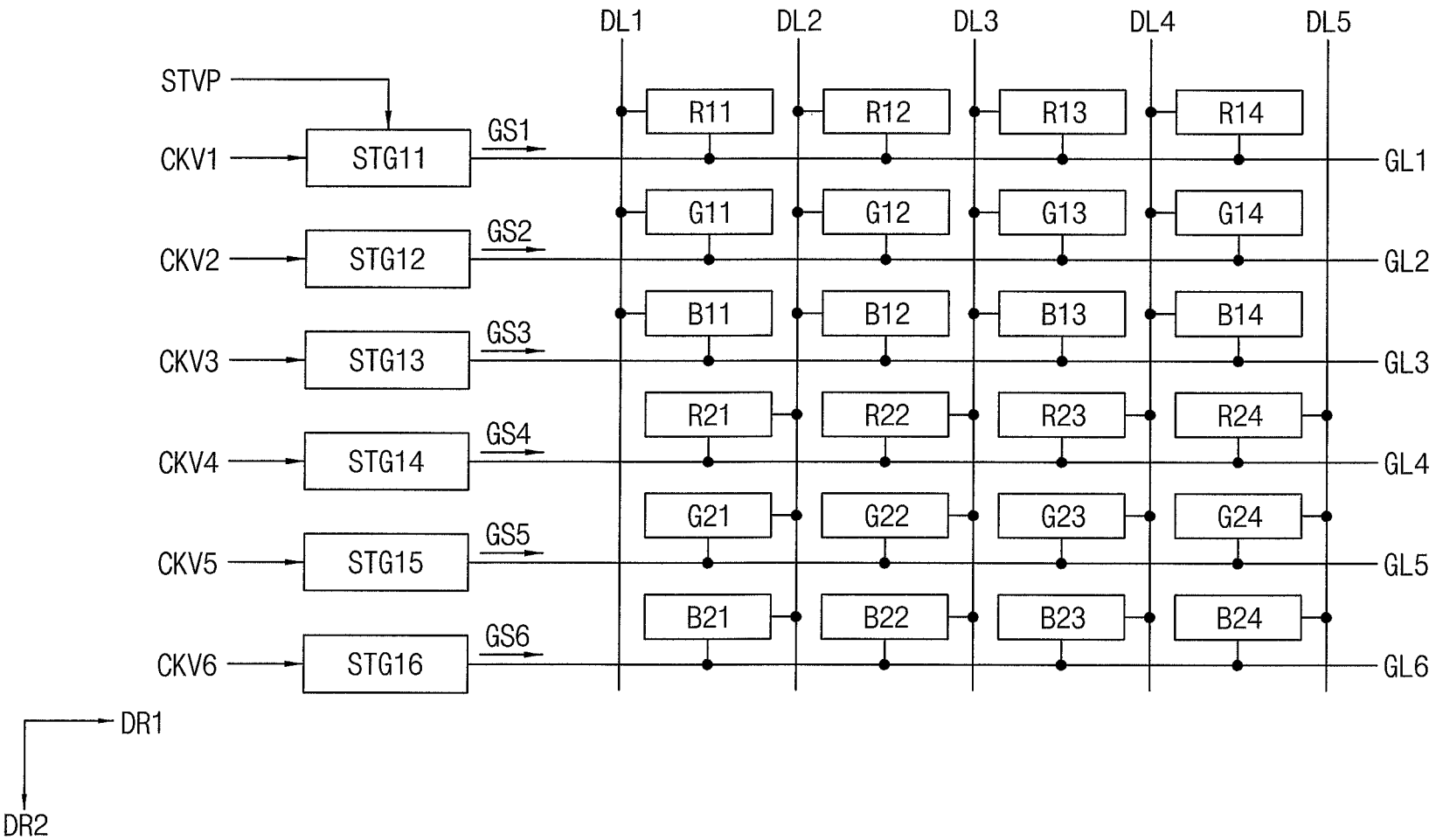
FIGS. 9 and 10 are diagrams illustrating an operation of a display apparatus including the gate driving control circuit of FIG. 8.
Figure 10:
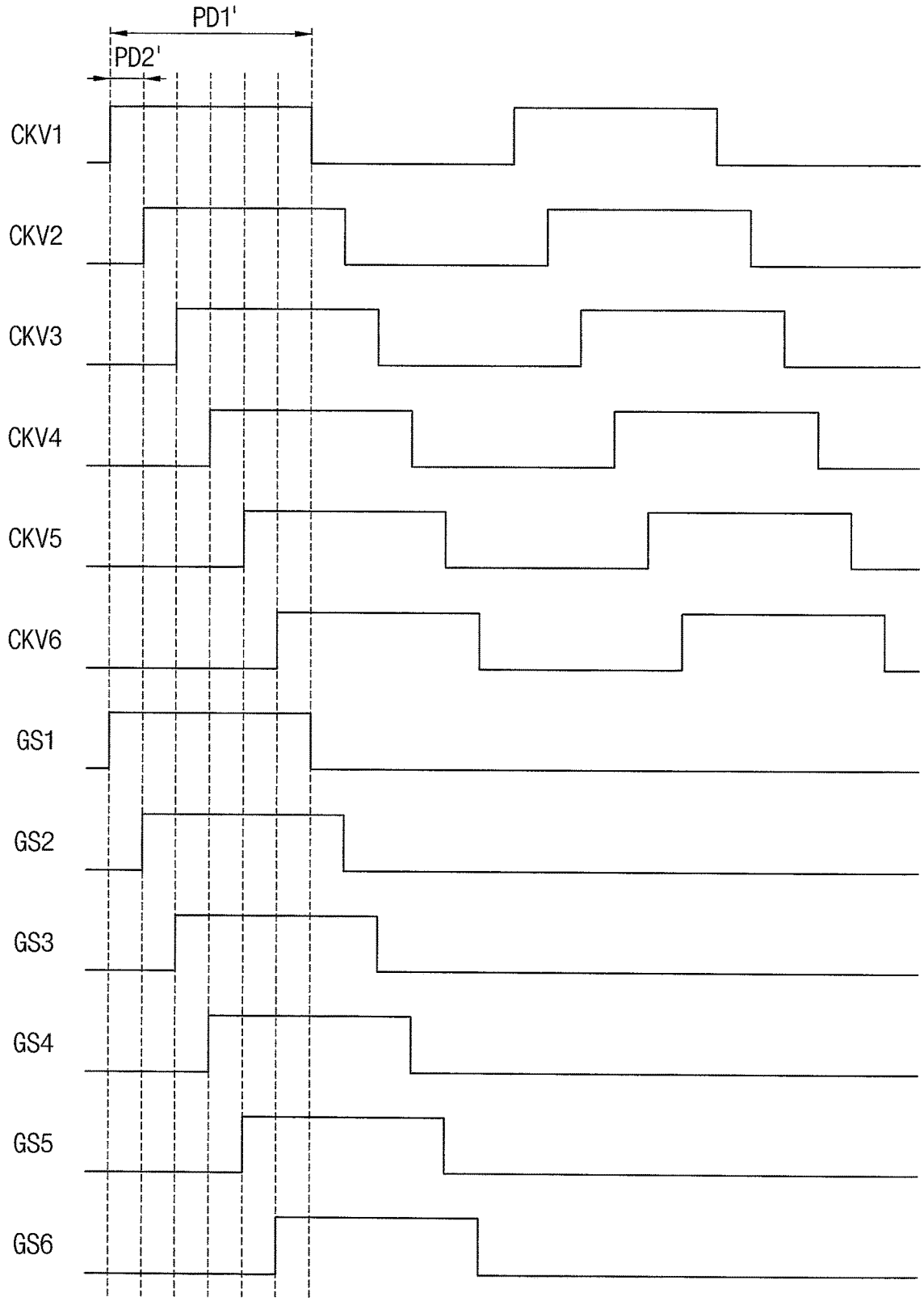

FIGS. 9 and 10 are diagrams illustrating an operation of a display apparatus including the gate driving control circuit of FIG. 8.

Referring to FIGS. 8 and 9, a display panel (e.g., the display panel 100 in FIG. 1) may include a plurality of pixels R11-R14, R21-R24, G11-G14, G21-G24, B11-B14 and B21-B24, and a gate driver (e.g., the gate driver 300 in FIG. 1) may include a plurality of stages STG11-STG16.

An exemplary embodiment of FIG. 9 may be substantially the same as an exemplary embodiment of FIG. 5, except that gate clock signals CKV4-CKV6 applied to some stages STG14-STG16 are changed in FIG. 9.

Each stage may generate a respective one of the gate signals GS1-GS6 for driving a respective one of the gate lines GL1-GL6 based on a respective one of the gate clock signals CKV1-CKV6.

In an exemplary embodiment of FIG. 9, operations of the first, second and third stages STG11-STG13 may be substantially the same as operations described with reference to FIG. 5. The fourth stage STG14 may generate the fourth gate signal GS4 to be applied to the fourth gate line GL4 based on the fourth gate clock signal CKV4. The fifth stage STG15 may generate the fifth gate signal GS5 to be applied to the fifth gate line GL5 based on the fifth gate clock signal CKV5. The sixth stage STG16 may generate the sixth gate signal GS6 to be applied to the sixth gate line GL6 based on the sixth gate clock signal CKV6.

Although not illustrated in FIG. 9, a plurality of pixels may be additionally arranged in the first and second directions DR1 and DR2, and a plurality of stages may be additionally arranged in the second direction DR2. In one exemplary embodiment, for example, each of seventh through twelfth gate signals to be applied to a respective one of seventh through twelfth gate lines subsequent to the sixth gate line GL6 may be generated based on a respective one of the inversion gate clock signals CKVB1-CKVB6, and each of thirteenth through eighteenth gate signals to be applied to a respective one of thirteenth through eighteenth gate lines subsequent to the twelfth gate line may be generated based on a respective one of the gate clock signals CKV1-CKV6.

In some exemplary embodiments, the plurality of pixels may have one of various configurations and/or one of various arrangements.

Referring to FIGS. 8 and 10, a phase of one of the gate clock signals CKV1-CKV6 may partially overlap a phase of another gate clock signal, from among the gate clock signals CKV1-CKV6. In one exemplary embodiment, for example, each of the gate clock signals CKV1-CKV6 may have the ON level for a first period PD1', and two adjacent gate clock signals may have a phase difference by a second period PD2'.

In an exemplary embodiment of FIG. 10, a length of the second period PD2' may be about one sixth of a length of the first period PD1'. In one exemplary embodiment, for example, the first period PD1' may correspond to six consecutive horizontal periods (6H), and the second period PD2' may correspond to one horizontal period. In this example, each of the gate clock signals CKV1-CKV6 may have the ON level for six consecutive horizontal periods, and two adjacent gate clock signals may simultaneously have the ON level for five consecutive horizontal periods. In one alternative exemplary embodiment, for example, the length of the first period PD1' in FIG. 10 may be substantially the same as the length of the first period PD1 in FIG. 6.

Each of the gate signals GS1-GS6 may include a pulse that is included in a respective one of the gate clock signals CKV1-CKV6. Although not illustrated in FIG. 10, each of the inversion gate clock signals CKVB1-CKVB6 may have a phase opposite to that of a respective one of the gate clock signals CKV1-CKV6.

Figure 11:
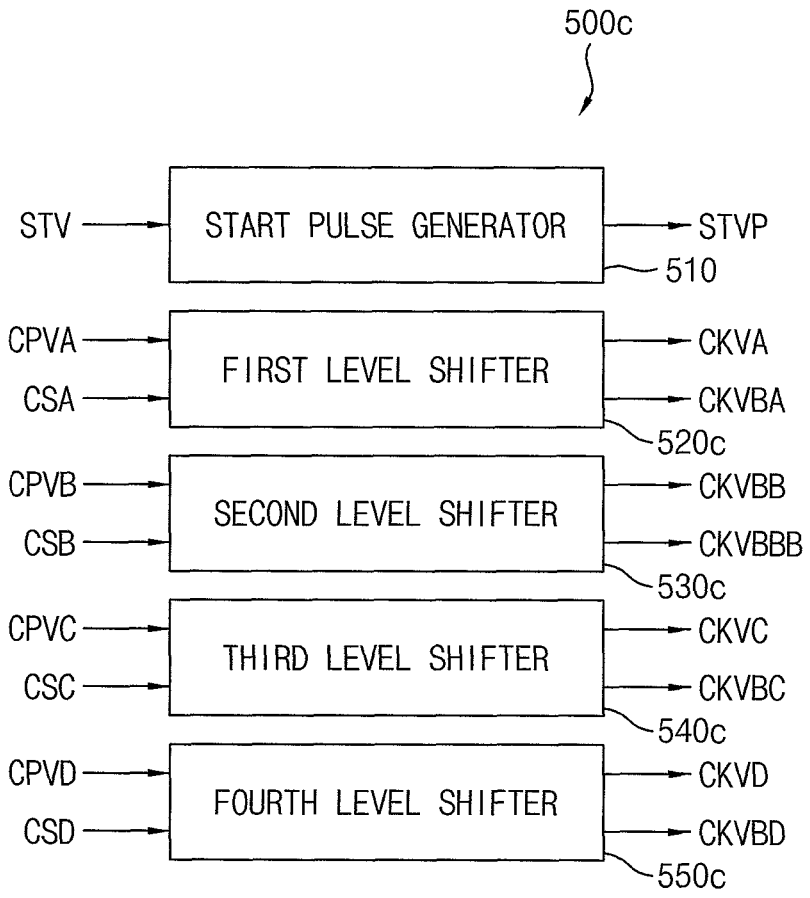
FIG. 11 is a block diagram illustrating still another exemplary embodiment of a gate driving control circuit included in a display apparatus.

FIG. 11 is a block diagram illustrating still another exemplary embodiment of a gate driving control circuit included in a display apparatus.

Referring to FIG. 11, an exemplary embodiment of a gate driving control circuit 500*c* may include a start pulse generator 510, a first level shifter 520*c*, a second level shifter 530*c*, a third level shifter 540*c* and a fourth level shifter 550*c*.

The start pulse generator 510 in FIG. 11 may be substantially the same as the start pulse generator 510 in FIG. 2.

The first level shifter 520*c* may generate a first gate clock signal CKVA and a first inversion gate clock signal CKVBA based on a first gate clock control signal CPVA and a first charge sharing control signal CSA. The second level shifter 530*c* may generate a second gate clock signal CKVBB and a second inversion gate clock signal CKVBBB based on a second gate clock control signal CPVB and a second charge sharing control signal CSB. The third level shifter 540*c* may generate a third gate clock signal CKVC and a third inversion gate clock signal CKVBC based on a third gate clock control signal CPVC and a third charge sharing control signal CSC. The fourth level shifter 550*c* may generate a fourth gate clock signal CKVD and a fourth inversion gate clock signal CKVBD based on a fourth gate clock control signal CPVD and a fourth charge sharing control signal CSD. An operation and a configuration of each of the first level shifter 520*c*, the second level shifter 530*c*, the third level shifter 540*c* and the fourth level shifter 550*c* may be substantially the same as those of the first level shifter 520*a* described with reference to FIGS. 4A and 4B.

In such an embodiment, the gate driving control circuit 500*c* may generate four gate clock signals CKVA-CKVD and four inversion gate clock signal CKVBA-CKVBD based on four gate clock control signals CPVA-CPVD. Thus, the gate driving control circuit 500*c* may be employed or adopted to a display apparatus in which each of pixels has one of four different colors.

In some exemplary embodiments, as will be described with reference to FIG. 12, a plurality of pixels in a display apparatus including the gate driving control circuit 500*c* may include a plurality of red pixels that outputs red light, a plurality of green pixels that outputs green light, a plurality of blue pixels that outputs blue light and a plurality of white pixels that outputs white light. In other exemplary embodiments, a plurality of pixels that is included in a display apparatus including the gate driving control circuit 500*c* may have any four different colors.

Figure 12:
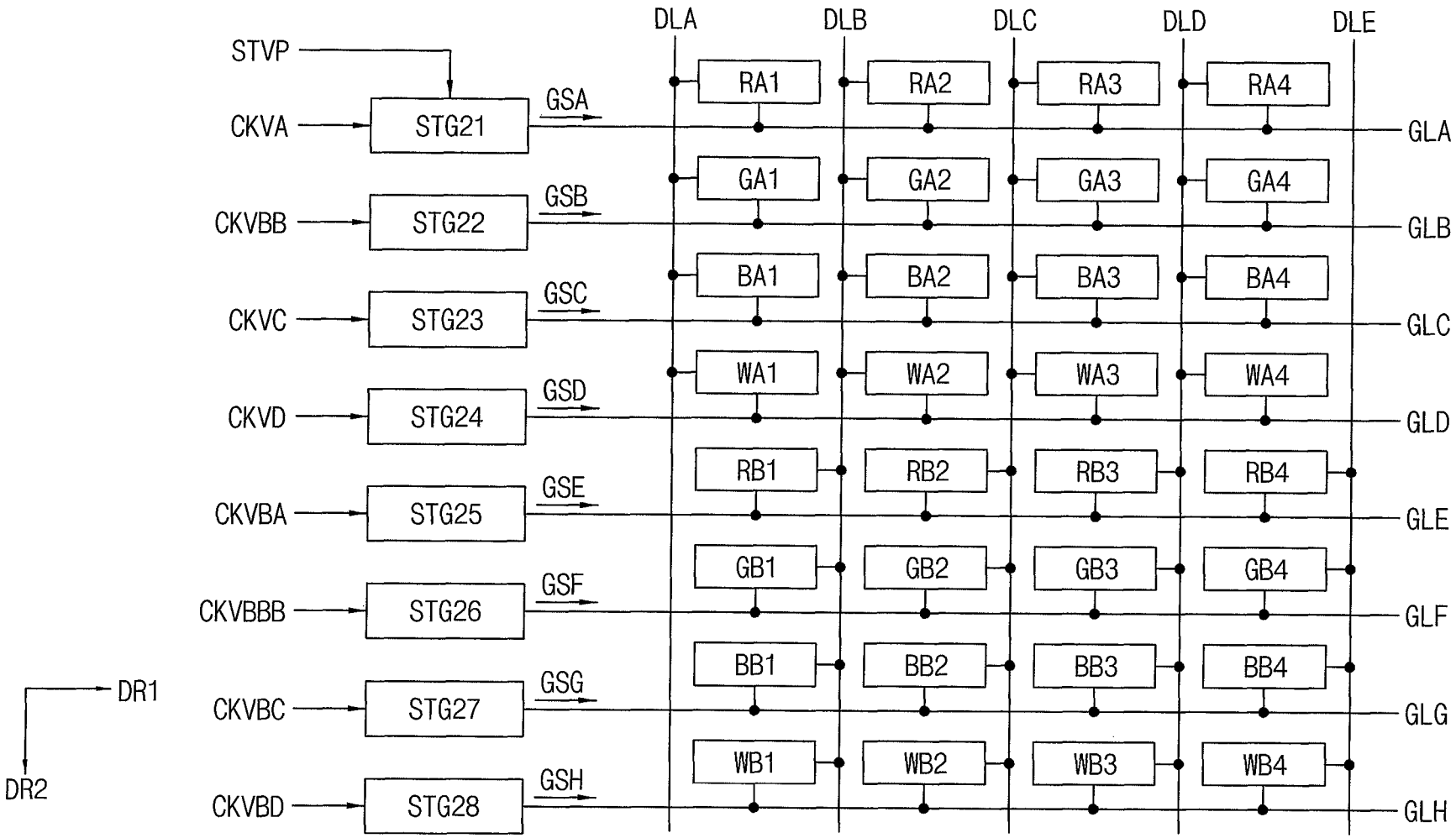
FIGS. 12 and 13 are diagrams illustrating an operation of a display apparatus including the gate driving control circuit of FIG. 11.
Figure 13:
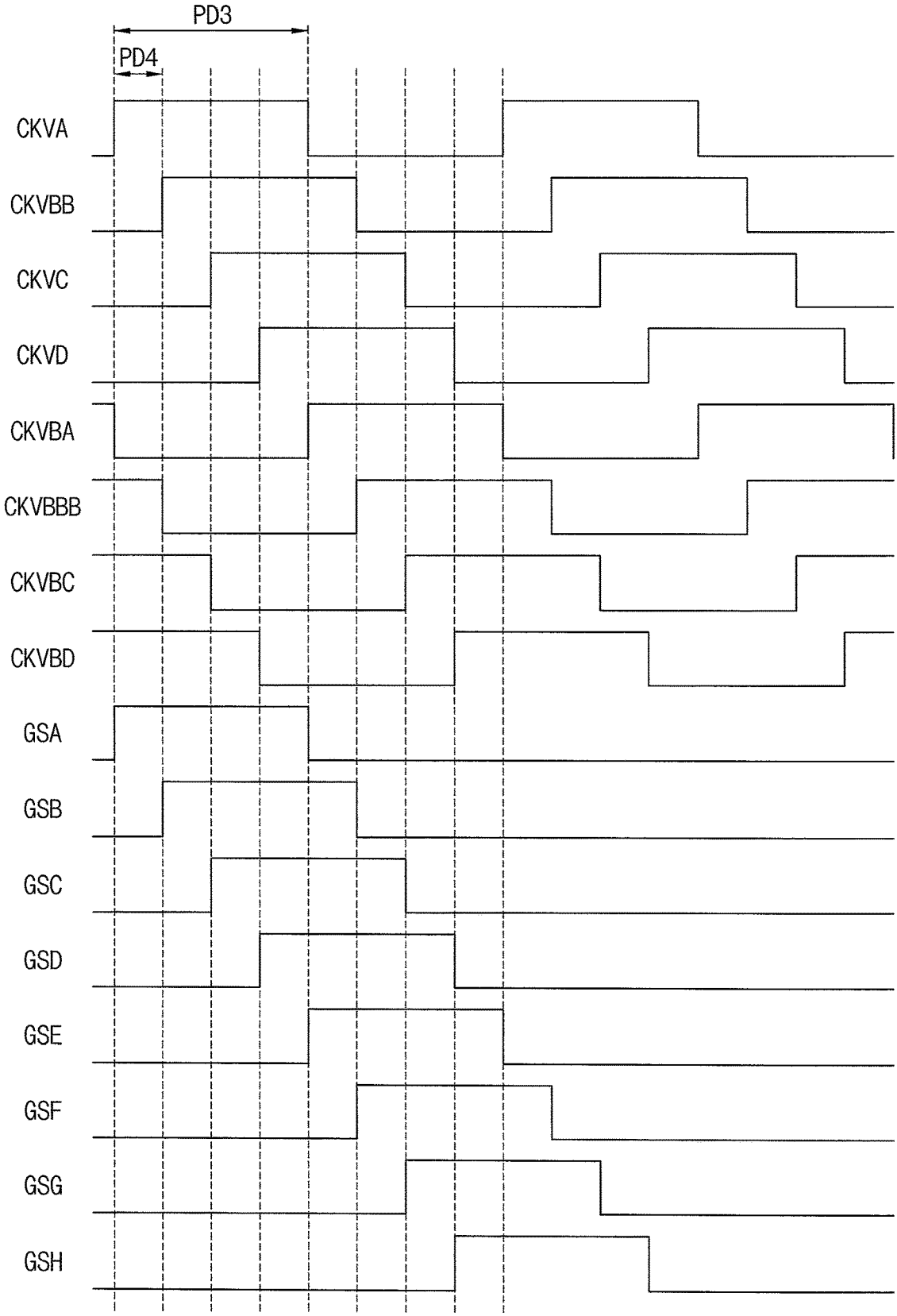

FIGS. 12 and 13 are diagrams illustrating an operation of a display apparatus including the gate driving control circuit of FIG. 11.

Referring to FIGS. 11 and 12, a display panel (e.g., the display panel 100 in FIG. 1) may include a plurality of pixels RA1, RA2, RA3, RA4, RB1, RB2, RB3, RB4, GA1, GA2, GA3, GA4, GB1, GB2, GB3, GB4, BA1, BA2, BA3, BA4, BB1, BB2, BB3, BB4, WA1, WA2, WA3, WA4, WB1, WB2, WB3 and WB4. Each pixel may be connected to a respective one of data lines DLA, DLB, DLC, DLD and DLE and a respective one of gate lines GLA, GLB, GLC, GLD, GLE, GLF, GLG and GLH. The plurality of pixels may include a plurality of red pixels RA1-RA4 and RB1-RB4, a plurality of green pixels GA1-GA4 and GB1-GB4, a plurality of blue pixels BA1-BA4 and BB1-BB4, and a plurality of white pixels WA1-WA4 and WB1-WB4. The gate lines GLA-GLH may be connected to the plurality of pixels based on the non-alternate scheme, and the data lines DLA-DLE may be connected to the plurality of pixels based on the alternate scheme.

In an exemplary embodiment of FIG. 12, each of the first red pixels RA1-RA4 may be connected to the first gate line GLA, each of the first green pixels GA1-GA4 may be connected to the second gate line GLB, each of the first blue pixels BA1-BA4 may be connected to the third gate line GLC, each of the first white pixels WA1-WA4 may be connected to the fourth gate line GLD, each of the second red pixels RB1-RB4 may be connected to the fifth gate line GLE, each of the second green pixels GB1-GB4 may be connected to the sixth gate line GLF, each of the second blue pixels BB1-BB4 may be connected to the seventh gate line GLG and each of the second white pixels WB1-WB4 may be connected to the eighth gate line GLH.

In an exemplary embodiment, some of the pixels RA1, GA1, BA1 and WA1 may be connected to the first data line DLA, some of the pixels RB1, GB1, BB1, WB1, RA2, GA2, BA2 and WA2 may be connected to the second data line DLB, some of the pixels RB2, GB2, BB2, WB2, RA3, GA3, BA3 and WA3 may be connected to the third data line DLC, some of the pixels RB3, GB3, BB3, WB3, RA4, GA4, BA4 and WA4 may be connected to the fourth data line DLD, and some of the pixels RB4, GB4, BB4 and WB4 may be connected to the fifth data line DLE.

A gate driver (e.g., the gate driver 300 in FIG. 1) may include a plurality of stages STG21, STG22, STG23, STG24, STG25, STG26, STG27 and STG28. Each stage may generate a respective one of gate signals GSA, GSB, GSC, GSD, GSE, GSF, GSG and GSH for driving a respective one of the gate lines GLA-GLH based on a respective one of the gate clock signals CKVA-CKVD and the inversion gate clock signals CKVBA-CKVBD.

In some exemplary embodiments, gate lines connected to pixels having a same color may operate or may be driven based on a same gate clock control signal. In such embodiments, gate signals to be applied to the gate lines connected to the pixels having a same color may be generated based on a same gate clock control signal. In one exemplary embodiment, for example, the gate signals GSA and GSE to be applied to the gate lines GLA and GLE connected to the red pixels RA1-RA4 and RB1-RB4 may be generated based on the clock signals CKVA and CKVBA that are generated based on the first gate clock control signal CPVA. In such an embodiment, the gate signals GSB and GSF to be applied to the gate lines GLB and GLF connected to the green pixels GA1-GA4 and GB1-GB4 may be generated based on the clock signals CKVBB and CKVBBB that are generated based on the second gate clock control signal CPVB, the gate signals GSC and GSG to be applied to the gate lines GLC and GLG connected to the blue pixels BA1-BA4 and BB1-BB4 may be generated based on the clock signals CKVC and CKVBC that are generated based on the third gate clock control signal CPVC, and the gate signals GSD and GSH to be applied to the gate lines GLD and GLH connected to the white pixels WA1-WA4 and WB1-WB4 may be generated based on the clock signals CKVD and CKVBD that are generated based on the fourth gate clock control signal CPVD.

In an exemplary embodiment of the display apparatus, gate lines (e.g., the gate lines GLA and GLE) that are connected to pixels having a same color (e.g., the red pixels RA1-RA4 and RB1-RB4) may operate or may be driven based on clock signals (e.g., the clock signals CKVA and CKVBA) that are generated for a same charge sharing operation. Accordingly, a duration for charging the pixels may be increased, and a difference of charging rates due to an output deviation of the level shifters and/or a horizontal spot on the display panel due to the difference of the charging rates may be effectively prevented.

Although not illustrated in FIG. 12, a plurality of pixels may be additionally arranged in the first and second directions DR1 and DR2, and a plurality of stages may be additionally arranged in the second direction DR2. In such an embodiment, each of ninth through sixteenth gate signals to be applied to a respective one of ninth through sixteenth gate lines subsequent to the eighth gate line GLH may be generated based on a respective one of the gate clock signals CKVA-CKVD and the inversion gate clock signals CKVBA-CKVBD.

In some exemplary embodiments, the plurality of pixels may have one of various configurations and/or one of various arrangements.

Referring to FIGS. 11 and 13, a phase of one of the gate clock signals CKVA-CKVD may partially overlap a phase of another gate clock signal, from among the gate clock signals CKVA-CKVD. In one exemplary embodiment, for example, each of the gate clock signals CKVA-CKVD may have the ON level for a first period PD3, and two adjacent gate clock signals may have a phase difference by a second period PD4.

In an exemplary embodiment of FIG. 13, a length of the second period PD4 may be about one fourth of a length of the first period PD3. In one exemplary embodiment, for example, the first period PD3 may correspond to four consecutive horizontal periods (4H), and the second period PD4 may correspond to one horizontal period. In this example, each of the gate clock signals CKVA-CKVD may have the ON level for four consecutive horizontal periods, and two adjacent gate clock signals may simultaneously have the ON level for three consecutive horizontal periods.

Each of the inversion gate clock signals CKVBA-CKVBD may have a phase opposite to that of a respective one of the gate clock signals CKVA-CKVD. Each of the gate signals GSA-GSH may include a pulse that is included in a respective one of the gate clock signals CKVA-CKVD and the inversion gate clock signals CKVBA-CKVBD.

Figure 14:
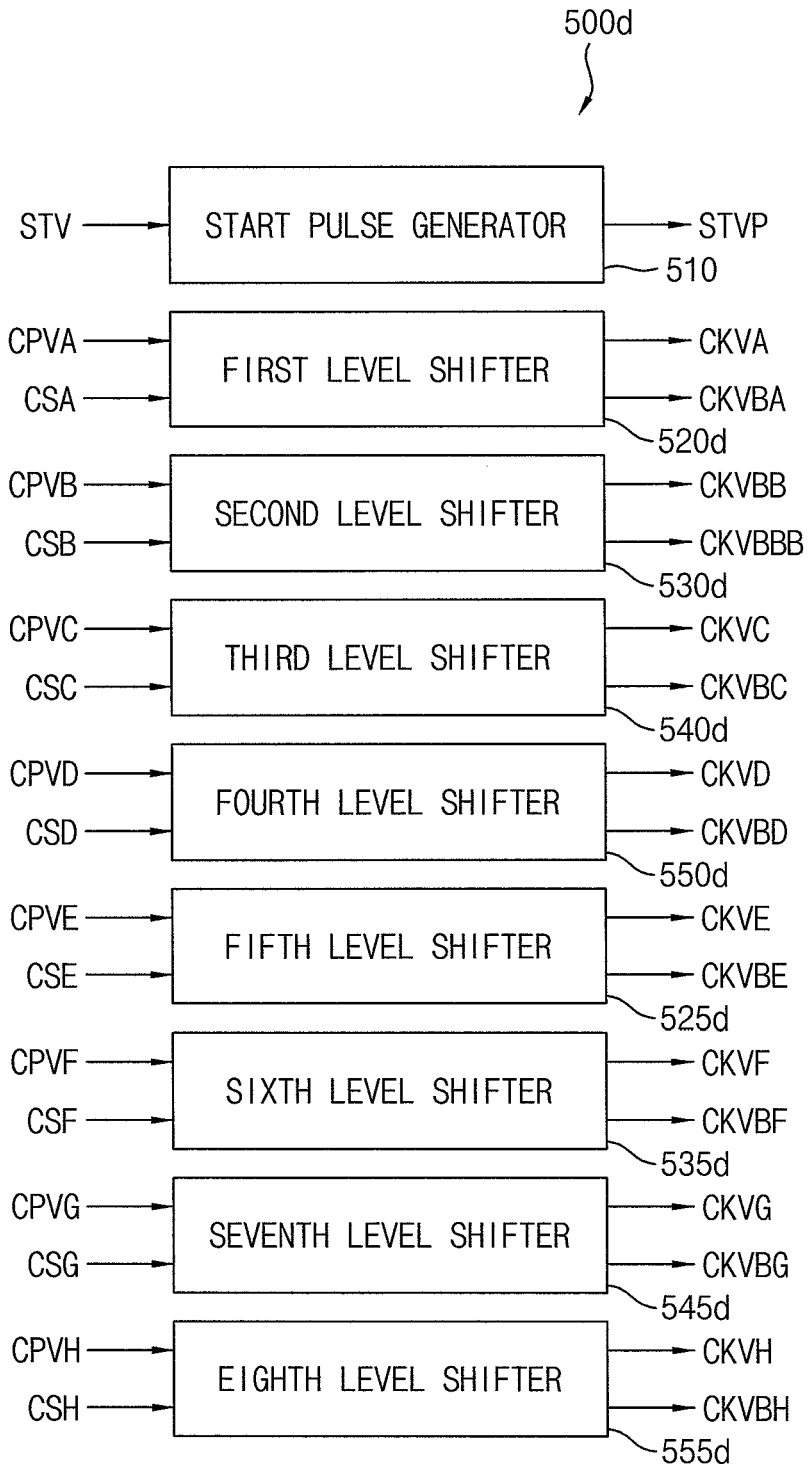
FIG. 14 is a block diagram illustrating still another exemplary embodiment of a gate driving control circuit included in a display apparatus.

FIG. 14 is a block diagram illustrating still another exemplary embodiment of a gate driving control circuit included in a display apparatus.

Referring to FIG. 14, an exemplary embodiment of a gate driving control circuit 500*d* may include a start pulse generator 510, a first level shifter 520*d*, a second level shifter 530*d*, a third level shifter 540*d*, a fourth level shifter 550*d*, a fifth level shifter 525*d*, a sixth level shifter 535*d*, a seventh level shifter 545*d* and an eighth level shifter 555*d*.

The start pulse generator 510 in FIG. 14 may be substantially the same as the start pulse generator 510 in FIG. 2. The first level shifter 520*d*, the second level shifter 530*d*, the third level shifter 540*d* and the fourth level shifter 550*d* in FIG. 14 may be substantially the same as the first level shifter 520*c*, the second level shifter 530*c*, the third level shifter 540*c* and the fourth level shifter 550*c* in FIG. 11, respectively.

The fifth level shifter 525*d* may generate a fifth gate clock signal CKVE and a fifth inversion gate clock signal CKVBE based on a fifth gate clock control signal CPVE and a fifth charge sharing control signal CSE. The sixth level shifter 535*d* may generate a sixth gate clock signal CKVF and a sixth inversion gate clock signal CKVBF based on a sixth gate clock control signal CPVF and a sixth charge sharing control signal CSF. The seventh level shifter 545*d* may generate a seventh gate clock signal CKVG and a seventh inversion gate clock signal CKVBG based on a seventh gate clock control signal CPVG and a seventh charge sharing control signal CSG. The eighth level shifter 555*d* may generate an eighth gate clock signal CKVH and an eighth inversion gate clock signal CKVBH based on an eighth gate clock control signal CPVH and an eighth charge sharing control signal CSH. An operation and a configuration of each of the fifth level shifter 525*d*, the sixth level shifter 535*d*, the seventh level shifter 545*d* and the eighth level shifter 555*d* may be substantially the same as those of the first level shifter 520*a* described with reference to FIGS. 4A and 4B.

In an exemplary embodiment, the gate driving control circuit 500*d* may generate eight gate clock signals CKVA-CKVH and eight inversion gate clock signal CKVBA-CKVBH based on eight gate clock control signals CPVA-CPVH. Thus, the gate driving control circuit 500*d* may be employed or adopted to a display apparatus in which each of pixels has one of four different colors.

Figure 15:
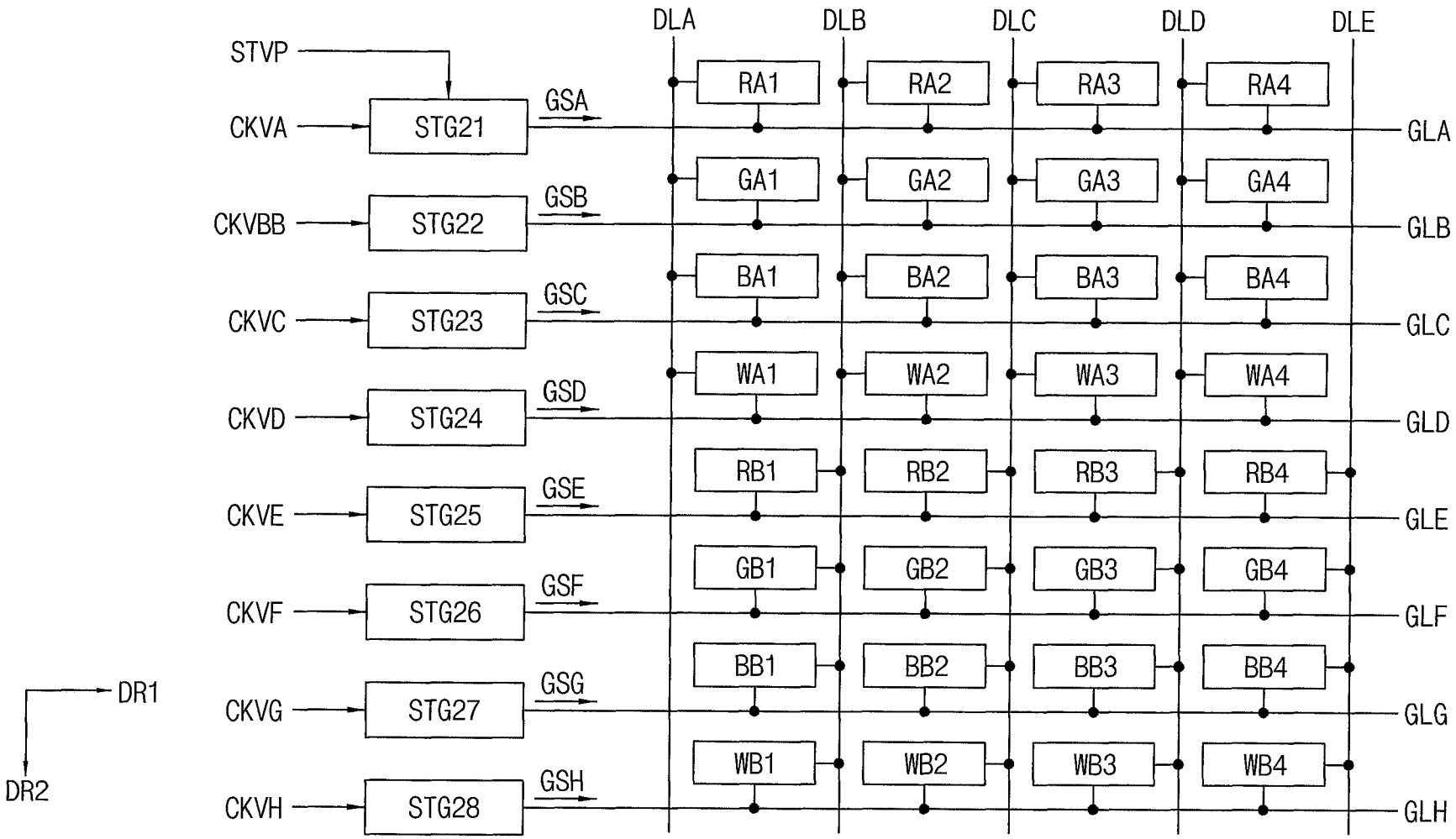
FIGS. 15 and 16 are diagrams illustrating an operation of a display apparatus including the gate driving control circuit of FIG. 14.
Figure 16:
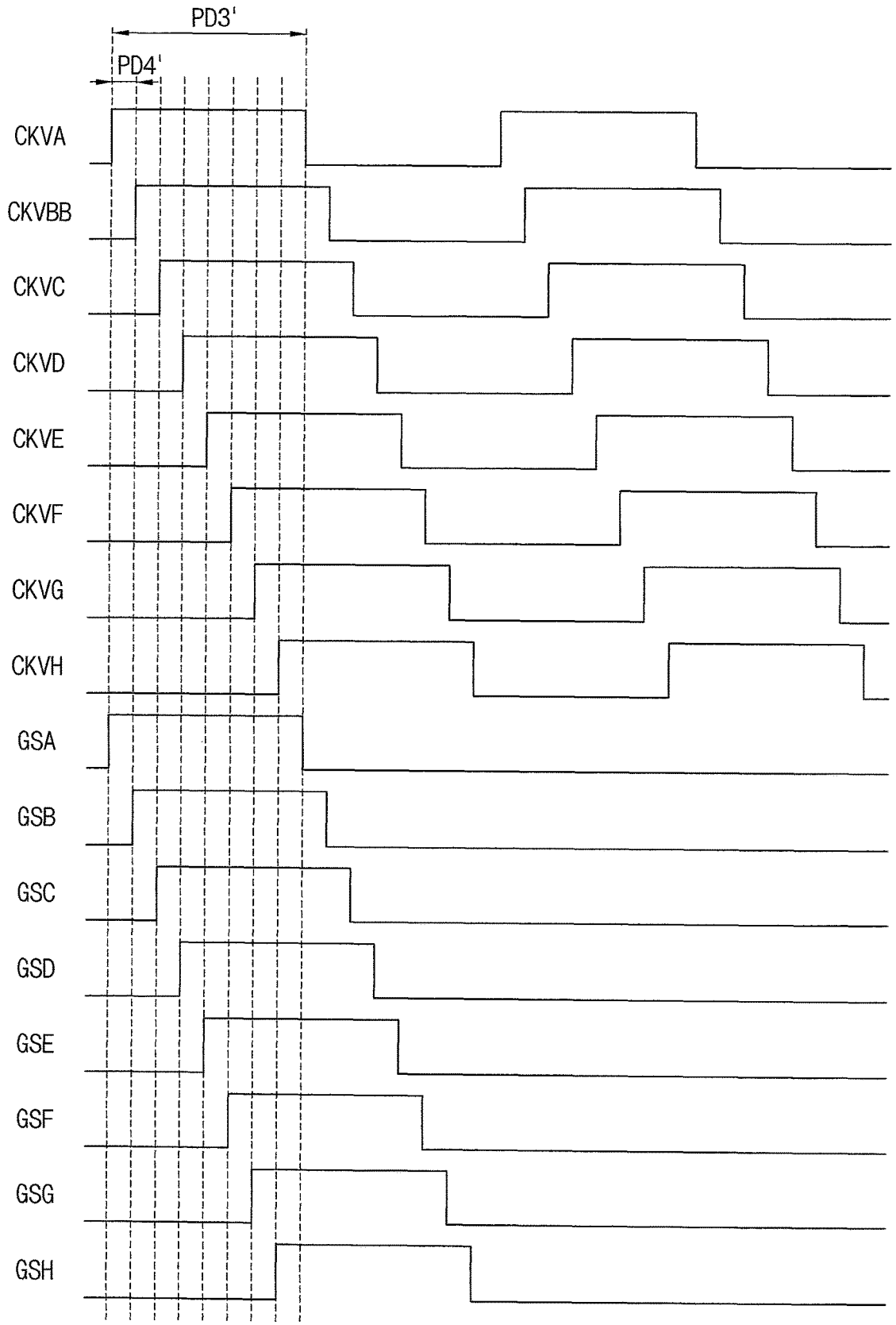

FIGS. 15 and 16 are diagrams illustrating an operation of a display apparatus including the gate driving control circuit of FIG. 14.

Referring to FIGS. 14 and 15, a display panel (e.g., the display panel 100 in FIG. 1) may include a plurality of pixels RA1-RA4, RB1-RB4, GA1-GA4, GB1-GB4, BA1-BA4, BB1-BB4, WA1-WA4 and WB1-WB4, and a gate driver (e.g., the gate driver 300 in FIG. 1) may include a plurality of stages STG21-STG28.

An exemplary embodiment of FIG. 15 may be substantially the same as an exemplary embodiment of FIG. 12, except for gate clock signals CKVE-CKVH applied to some stages STG25-STG28.

Each stage may generate a respective one of the gate signals GSA-GSH for driving a respective one of the gate lines GLA-GLH based on a respective one of the gate clock signals CKVA-CKVH.

Although not illustrated in FIG. 15, a plurality of pixels may be additionally arranged in the first and second directions DR1 and DR2, and a plurality of stages may be additionally arranged in the second direction DR2. In such an embodiment, each of ninth through sixteenth gate signals to be applied to a respective one of ninth through sixteenth gate lines subsequent to the eighth gate line GLH may be generated based on a respective one of the inversion gate clock signals CKVBA-CKVBH, and each of seventeenth through twenty-fourth gate signals to be applied to a respective one of seventeenth through twenty-fourth gate lines subsequent to the sixteenth gate line may be generated based on a respective one of the gate clock signals CKVA-CKVH.

In some exemplary embodiments, the plurality of pixels may have one of various configurations and/or one of various arrangements.

Referring to FIGS. 14 and 16, a phase of one of the gate clock signals CKVA-CKVH may partially overlap a phase of another gate clock signal, from among the gate clock signals CKVA-CKVH. In one exemplary embodiment, for example, each of the gate clock signals CKVA-CKVH may have the ON level for a first period PD3', and two adjacent gate clock signals may have a phase difference by a second period PD4'.

In an exemplary embodiment of FIG. 16, a length of the second period PD4' may be about one eighth of a length of the first period PD3'. In one exemplary embodiment, for example, the first period PD3' may correspond to eight consecutive horizontal periods (8H), and the second period PD4' may correspond to one horizontal period. In this example, each of the gate clock signals CKVA-CKVH may have the ON level for eight consecutive horizontal periods, and two adjacent gate clock signals may simultaneously have the ON level for seven consecutive horizontal periods. In one alternative exemplary embodiment, for example, the length of the first period PD3' in FIG. 16 may be substantially the same as the length of the first period PD3 in FIG. 13.

Each of the gate signals GSA-GSH may include a pulse that is included in a respective one of the gate clock signals CKVA-CKVH. Although not illustrated in FIG. 16, each of the inversion gate clock signals CKVBA-CKVBH may have a phase opposite to that of a respective one of the gate clock signals CKVA-CKVH.

Figure 17:
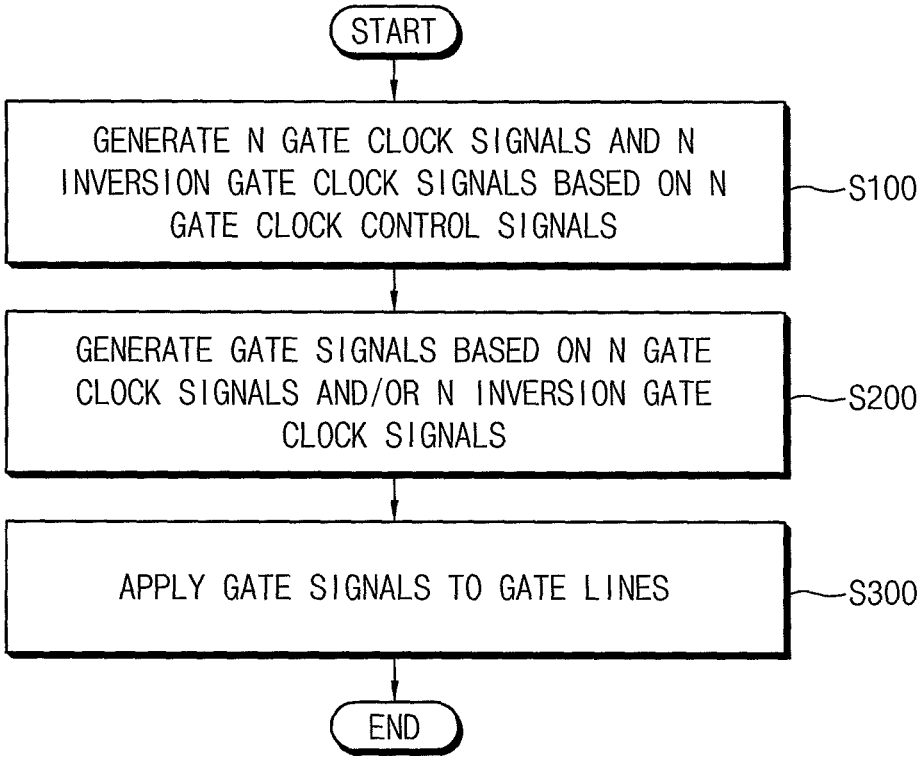
FIG. 17 is a flow chart illustrating a method of operating a display apparatus according to exemplary embodiment embodiments.

FIG. 17 is a flow chart illustrating a method of operating a display apparatus according to exemplary embodiments.

Referring to FIGS. 1 and 17, in an exemplary embodiment of a method of operating the display apparatus 10, the N gate clock signals CKV and the N inversion gate clock signals CKVB are generated based on the N gate clock control signals CPV, where N is a natural number greater than or equal to two (S100). The phases of the N gate clock signals CKV partially overlap with each other, each of the N inversion gate clock signals CKVB has a phase opposite to that of a respective one of the N gate clock signals CKV. The plurality of gate signals are generated based on the N gate clock signals CKV and/or the N inversion gate clock signals CKVB (S200). The plurality of gate signals are applied to the plurality of gate lines GL (S300).

Each of the plurality of pixels PX has a longer side (e.g., a relatively long side) in parallel with the gate lines GL and a shorter side (e.g., a relatively short side) in parallel with the data lines DL. The number (e.g., N) of the gate clock control signals CPV is an integer multiple of the number of colors of the plurality of pixels PX.

In some exemplary embodiments, when each of the pixels PX has one of three different colors (e.g., red, green and blue), the number of the gate clock control signals CPV may be a multiple of three. In other exemplary embodiments, when each of the pixels PX has one of four different colors (e.g., red, green, blue and white), the number of the gate clock control signals CPV may be a multiple of four. In these examples, gate signals to be applied to gate lines connected to pixels having a same color may be generated based on a same gate clock control signal.

In exemplary embodiments of the display apparatus according to the invention, gate lines (e.g., the gate lines GL1 and GL4) that are connected to pixels having a same color (e.g., the red pixels R11-R14 and R21-R24) may operate or may be driven based on clock signals (e.g., the clock signals CKV1 and CKVB1) that are generated based on a same gate clock control signal (e.g., the gate clock control signal CPV1). Accordingly, a duration for charging the pixels may be increased, and a difference of charging rates due to an output deviation of the level shifters and/or a horizontal spot on the display panel due to the difference of the charging rates may be effectively prevented.

Although some exemplary embodiments, where the plurality of pixels have a specific number of colors and the display apparatus generates a specific number of gate clock control signals, are described herein, but not being limited thereto. Exemplary embodiments may be employed to a case where each the number of gate clock control signals is any integer multiple of the number of the colors of pixels and a same gate clock control signal is used for driving pixels having the same color.

Although some exemplary embodiments, where the gate signals are generated based on both the gate clock signals and the inversion gate clock signals, are described herein, but not being limited thereto. Exemplary embodiments may be employed to a case where gate signals are generated based on gate clock signals or inversion gate clock signals.

The exemplary embodiments set forth herein may be used in a display apparatus and/or a system including the display apparatus, such as a mobile phone, a smart phone, a personal digital assistant ("PDA"), a portable multimedia player ("PMP"), a digital camera, a digital television, a set-top box, a music player, a portable game console, a navigation device, a personal computer ("PC"), a server computer, a workstation, a tablet computer, a laptop computer, etc.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings and advantages of the inventive concept. Accordingly, all such modifications are intended to be included within the scope of the inventive concept as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. A display apparatus comprising:

a gate driving control circuit which generates N gate clock signals and N inversion gate clock signals based on N gate clock control signals, wherein N is a natural number greater than or equal to two, phases of the N gate clock signals partially overlap with each other, and each of the N inversion gate clock signals has a phase opposite to a phase of a respective one of the N gate clock signals;

a gate driver which generates a plurality of gate signals based on the N gate clock signals or the N inversion gate clock signals, and applies the plurality of gate signals to a plurality of gate lines, wherein each of the plurality of gate signals is generated based on either one of the N gate clock signals or one of the N inversion gate clock signals; and a display panel including a plurality of pixels, each of which is connected to a respective one of the plurality of gate lines and a respective one of a plurality of data lines, wherein each of the plurality of pixels has a longer side in parallel with the plurality of gate lines and a shorter side in parallel with the plurality of data lines, wherein a number of the gate clock control signals is an integer multiple of a number of colors of the plurality of pixels, wherein gate signals to be applied to gate lines connected to pixels having a same color are generated based on a same gate clock control signal among the N gate clock control signals, wherein gate signals to be applied to gate lines connected to pixels having different colors, respectively, are generated based on different gate clock control signals among the N gate clock control signals, wherein the gate driving control circuit includes N level shifters, wherein each of the N level shifters generates a respective one of the N gate clock signals and a respective one of the N inversion gate clock signals based on a respective one of the N gate clock control signals and a respective one of N charge sharing control signals, and wherein a first level shifter among the N level shifters comprises:

a first p-type metal oxide semiconductor transistor connected between a gate-on voltage and a first output terminal which outputs a first gate clock signal, where the first p-type metal oxide semiconductor transistor has a gate electrode which receives a first gate clock control signal;

a first n-type metal oxide semiconductor transistor connected between a gate-off voltage and the first output terminal, wherein the first n-type metal oxide semiconductor transistor has a gate electrode which receives the first gate clock control signal;

a second p-type metal oxide semiconductor transistor connected between the gate-on voltage and a second output terminal which outputs a first inversion gate clock signal, wherein the second p-type metal oxide semiconductor transistor has a gate electrode which receives a first inversion gate clock control signal;

a second p-type metal oxide semiconductor transistor connected between the gate-off voltage and the second output terminal, wherein the second n-type metal oxide semiconductor transistor has a gate electrode which receives the first inversion gate clock control signal; and third and fourth p-type metal oxide semiconductor transistors connected in series between the first output terminal and the second output terminal, wherein each of the third and fourth p-type metal oxide semiconductor transistors has a gate electrode which receives a first charge sharing control signal.

2. The display apparatus of claim 1, wherein the plurality of pixels include a plurality of red pixels which outputs red light, a plurality of green pixels which outputs green light and a plurality of blue pixels which outputs blue light, the number of the gate clock control signals is a multiple of three, each of a number of the gate clock signals and a number of the inversion gate clock signals is substantially equal to the number of the gate clock control signals.

3. The display apparatus of claim 2, wherein the plurality of red pixels include a first red pixel connected to a first gate line, the plurality of green pixels include a first green pixel connected to a second gate line, and the plurality of blue pixels include a first blue pixel connected to a third gate line, the first, second and third gate lines are adjacent to each other, the gate driver generates first, second and third gate signals based on first, second and third gate clock signals, and each of the first, second and third gate signals are applied to a respective one of the first, second and third gate lines.

4. The display apparatus of claim 3, wherein the plurality of red pixels further include a second red pixel connected to a fourth gate line, the plurality of green pixels further include a second green pixel connected to a fifth gate line, the plurality of blue pixels further include a second blue pixel connected to a sixth gate line, the fourth, fifth and sixth gate lines are adjacent to each other, the number of the gate clock control signals is three, the gate driver generates fourth, fifth and sixth gate signals based on first, second and third inversion gate clock signals, and each of the fourth, fifth and sixth gate signals are applied to a respective one of the fourth, fifth and sixth gate lines.

5. The display apparatus of claim 4, wherein an arrangement of the second red pixel, the second green pixel and the second blue pixel is substantially the same as an arrangement of the first red pixel, the first green pixel and the first blue pixel.

6. The display apparatus of claim 4, wherein an arrangement of the second red pixel, the second green pixel and the second blue pixel is different from an arrangement of the first red pixel, the first green pixel and the first blue pixel.

7. The display apparatus of claim 4, wherein each of the first red pixel, the first green pixel and the first blue pixel is connected to a respective data line, which is located at a first side of a respective one of the first red pixel, the first green pixel and the first blue pixel, each of the second red pixel, the second green pixel and the second blue pixel is connected to a respective data line, which is located at a second side of a respective one of the second red pixel, the second green pixel and the second blue pixel, wherein the second side is opposite to the first side.

8. The display apparatus of claim 3, wherein the plurality of red pixels further include a second red pixel connected to a fourth gate line, the plurality of green pixels further include a second green pixel connected to a fifth gate line, the plurality of blue pixels further include a second blue pixel connected to a sixth gate line, the fourth, fifth and sixth gate lines are adjacent to each other, the number of the gate clock control signals is six, the gate driver generates fourth, fifth and sixth gate signals based on fourth, fifth and sixth gate clock signals, and each of the fourth, fifth and sixth gate signals are applied to a respective one of the fourth, fifth and sixth gate lines.

9. The display apparatus of claim 1, wherein the plurality of pixels include a plurality of red pixels which outputs red light, a plurality of green pixels which outputs green light, a plurality of blue pixels which outputs blue light, and a plurality of white pixels which outputs white light, the number of the gate clock control signals is a multiple of four, each of a number of the gate clock signals and a number of the inversion gate clock signals is substantially equal to the number of the gate clock control signals.

10. The display apparatus of claim 9, wherein the plurality of red pixels include a first red pixel connected to a first gate line, the plurality of green pixels include a first green pixel connected to a second gate line, the plurality of blue pixels include a first blue pixel connected to a third gate line, the plurality of white pixels include a first white pixel connected to a fourth gate line, the first, second, third and fourth gate lines are adjacent to each other, the gate driver generates first, second, third and fourth gate signals based on first, second, third and fourth gate clock signals, and each of the first, second, third and fourth gate signals are applied to a respective one of the first, second, third and fourth gate lines.

11. The display apparatus of claim 10, wherein the plurality of red pixels further include a second red pixel connected to a fifth gate line, the plurality of green pixels further include a second green pixel connected to a sixth gate line, the plurality of blue pixels further include a second blue pixel connected to a seventh gate line, the plurality of white pixels further include a second white pixel connected to an eighth gate line, the fifth, sixth, seventh and eighth gate lines are adjacent to each other, the number of the gate clock control signals is four, the gate generates fifth, sixth, seventh and eighth gate signals based on first, second, third and fourth inversion gate clock signals, and each of the fifth, sixth, seventh and eighth gate signals are applied to a respective one of the fifth, sixth, seventh and eighth gate lines.

12. The display apparatus of claim 10, wherein the plurality of red pixels further include a second red pixel connected to a fifth gate line, the plurality of green pixels further include a second green pixel connected to a sixth gate line, the plurality of blue pixels further include a second blue pixel connected to a seventh gate line, the plurality of white pixels further include a second white pixel connected to an eighth gate line, the fifth, sixth, seventh and eighth gate lines are adjacent to each other, the number of the gate clock control signals is eight, the gate driver generates fifth, sixth, seventh and eighth gate signals based on fifth, sixth, seventh and eighth gate clock signals, and each of the fifth, sixth, seventh and eighth gate signals are applied to a respective one of the fifth, sixth, seventh and eighth gate lines.

13. The display apparatus of claim 1, wherein the plurality of pixels is arranged in a display region of the display panel, and the gate driver is disposed in a peripheral region of the display panel surrounding the display region of the display panel.

14. A method of operating a display apparatus including a display panel, the display panel including a plurality of pixels, each of which is connected to a respective one of a plurality of gate lines and a respective one of a plurality of data lines, the method comprising:

generating N gate clock signals and N inversion gate clock signals by a gate driving control circuit of the display apparatus based on N gate clock control signals, wherein N is a natural number greater than or equal to two, phases of the N gate clock signals partially overlap with each other, and each of the N inversion gate clock signals having a phase opposite to a phase of a respective one of the N gate clock signals;

generating a plurality of gate signals based on the N gate clock signals or the N inversion gate clock signals, wherein each of the plurality of gate signals is generated based on either one of the N gate clock signals or one of the N inversion gate clock signals; and applying the plurality of gate signals to the plurality of gate lines, wherein each of the plurality of pixels has a longer side in parallel with the plurality of gate lines and a shorter side in parallel with the plurality of data lines, and wherein a number of the gate clock control signals is an integer multiple of a number of colors of the plurality of pixels, wherein gate signals to be applied to gate lines connected to pixels having a same color are generated based on a same gate clock control signal among the N gate clock control signals, wherein gate signals to be applied to gate lines connected to pixels having different colors, respectively, are generated based on different gate clock control signals among the N gate clock control signals, wherein the gate driving control circuit includes N level shifters, wherein each of the N level shifters generates a respective one of the N gate clock signals and a respective one of the N inversion gate clock signals based on a respective one of the N gate clock control signals and a respective one of N charge sharing control signals, and wherein a first level shifter among the N level shifters comprises:

a first p-type metal oxide semiconductor transistor connected between a gate-on voltage and a first output terminal which outputs a first gate clock signal, where the first p-type metal oxide semiconductor transistor has a gate electrode which receives a first gate clock control signal;

a first n-type metal oxide semiconductor transistor connected between a gate-off voltage and the first output terminal, wherein the first n-type metal oxide semiconductor transistor has a gate electrode which receives the first gate clock control signal;

a second p-type metal oxide semiconductor transistor connected between the gate-on voltage and a second output terminal which outputs a first inversion gate clock signal, wherein the second p-type metal oxide semiconductor transistor has a gate electrode which receives a first inversion gate clock control signal;

a second p-type metal oxide semiconductor transistor connected between the gate-off voltage and the second output terminal, wherein the second n-type metal oxide semiconductor transistor has a gate electrode which receives the first inversion gate clock control signal; and third and fourth p-type metal oxide semiconductor transistors connected in series between the first output terminal and the second output terminal, wherein each of the third and fourth p-type metal oxide semiconductor transistors has a gate electrode which receives a first charge sharing control signal.

15. The method of claim 14, wherein the plurality of pixels include a plurality of red pixels which outputs red light, a plurality of green pixels which outputs green light and a plurality of blue pixels which outputs blue light, the number of the gate clock control signals is a multiple of three, and each of a number of the gate clock signals and a number of the inversion gate clock signals is substantially equal to the number of the gate clock control signals.

16. The method of claim 14, wherein the plurality of pixels include a plurality of red pixels which outputs red light, a plurality of green pixels which outputs green light, a plurality of blue pixels which outputs blue light and a plurality of white pixels which outputs white light, the number of the gate clock control signals is a multiple of four, and each of a number of the gate clock signals and a number of the inversion gate clock signals is substantially equal to the number of the gate clock control signals.

* * * * *